US006644148B2

(12) United States Patent
Hu

(10) Patent No.: US 6,644,148 B2
(45) Date of Patent: Nov. 11, 2003

(54) REVERSIBLE RATCHET-TYPE WRENCH

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

(21) Appl. No.: 10/144,894

(22) Filed: May 13, 2002

(65) Prior Publication Data

US 2003/0150300 A1 Aug. 14, 2003

(30) Foreign Application Priority Data

Feb. 8, 2002 (TW) ..... 91201915 U

(51) Int. Cl.[7] ..... B25B 13/46

(52) U.S. Cl. ..... 81/63.2; 81/63

(58) Field of Search ..... 81/61, 62, 63, 81/63.1, 63.2

(56) References Cited

U.S. PATENT DOCUMENTS

| | | | | |
|---|---|---|---|---|
| 15,482 A | | 8/1856 | Gilman | 81/63 |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| RE13,205 E | | 2/1911 | Lane | |
| 1,033,358 A | | 7/1912 | Turner | |
| 1,078,059 A | | 11/1913 | Mossberg | |
| 1,194,471 A | | 8/1916 | Boosinger | |
| 1,261,092 A | | 4/1918 | Allen | |
| 1,382,492 A | | 6/1921 | Evans | 81/63 |
| 1,426,127 A | | 8/1922 | Tuttle | |
| 1,614,039 A | | 1/1927 | Mandl | |
| 1,957,462 A | | 5/1934 | Kress | 81/63 |
| 2,193,984 A | | 3/1940 | Rhinevault | |
| 2,201,705 A | | 5/1940 | Stone | |
| 2,201,827 A | | 5/1940 | Froeschl et al. | |
| 2,317,461 A | | 4/1943 | Jackson | |
| 2,542,241 A | | 2/1951 | Fors | |
| 2,657,604 A | | 11/1953 | Rueb | 81/63.2 |
| 2,701,977 A | | 2/1955 | Stone | |
| 2,764,048 A | | 9/1956 | Thompson | |
| 2,769,360 A | | 11/1956 | Cottrell et al. | |
| 2,800,821 A | | 7/1957 | Fruscella | |
| 2,891,434 A | | 6/1959 | Lozensky | |
| 2,957,377 A | | 10/1960 | Hare | |
| 2,963,929 A | * | 12/1960 | Barnes | 81/62 |
| 2,978,081 A | | 4/1961 | Lundin | |
| 3,019,682 A | | 2/1962 | Hare | 81/63.2 |
| 3,250,157 A | | 5/1966 | Badger | |
| 3,265,171 A | | 8/1966 | Kilness | 81/63 |
| 3,299,750 A | * | 1/1967 | Campanile et al. | 81/62 |
| 3,337,014 A | | 8/1967 | Sandrick | 81/63 |
| 3,393,587 A | | 7/1968 | Jolliff et al. | |
| 3,393,780 A | | 7/1968 | Kilness | 81/63 |
| 3,436,992 A | | 4/1969 | Over et al. | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—Joseph J. Hail, III
*Assistant Examiner*—David B. Thomas
(74) *Attorney, Agent, or Firm*—Alan D. Kamrath; Rider Bennett, LLP.

(57) ABSTRACT

A wrench comprises a handle and a head extending from the handle. A peripheral wall defining a hole in the head includes a compartment. An annular groove is defined in an end of the peripheral wall defining the hole. The annular groove is partially coincident with the compartment. A pawl is slidably received in the compartment and biased to engage with a gear wheel in the hole. A switching member is partially mounted in the hole for moving the pawl when switching of the ratcheting direction is required. A retainer ring is partially engaged in an annular groove in the switching member and partially engaged in the annular groove of the head. The retainer ring is retained in place by a wall defining the compartment. The switching member is not moved when the pawl moves as a result of free rotation of the wrench.

20 Claims, 32 Drawing Sheets

U.S. PATENT DOCUMENTS 3,577,816 A 5/1971 Alexander et al.
3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al. ..... 81/63
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A 9/1983 Gummow
4,420,995 A 12/1983 Roberts
4,485,700 A 12/1984 Colvin
4,488,460 A 12/1984 Ballone et al.
4,491,043 A * 1/1985 Dempsey et al. ..... 81/58
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus ..... 81/63.2
4,796,492 A 1/1989 Liou ..... 81/58.4
4,807,500 A 2/1989 Main
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella ..... 81/58.4
5,144,869 A 9/1992 Chow
5,157,994 A 10/1992 Krivec ..... 81/63.2
5,178,047 A 1/1993 Arnold et al. ..... 81/63.2
5,199,330 A 4/1993 Arnold et al.
5,199,335 A 4/1993 Arnold et al.
5,230,262 A 7/1993 Ahlund et al. ..... 81/63.2
5,231,903 A 8/1993 Bockman, Jr.
5,233,891 A 8/1993 Arnold et al. ..... 81/63.2
5,271,300 A 12/1993 Zurbuchen et al.
5,295,422 A 3/1994 Chow
5,392,672 A 2/1995 Larson et al.
5,425,291 A 6/1995 Chang ..... 81/60
5,467,672 A 11/1995 Ashby
5,477,757 A 12/1995 Maresh
5,495,783 A 3/1996 Slusar et al.
5,499,560 A 3/1996 Aeschliman
5,501,124 A 3/1996 Ashby
5,509,333 A 4/1996 Rion
5,533,427 A 7/1996 Chow ..... 81/63.2
5,557,994 A 9/1996 Nakayama
5,582,081 A 12/1996 Lin
5,584,220 A 12/1996 Darrah et al.
5,595,095 A 1/1997 Hillinger
5,626,061 A 5/1997 Whitley
5,626,062 A 5/1997 Colvin ..... 81/63.2
5,636,557 A 6/1997 Ma
5,669,875 A 9/1997 van Eerdenburg
5,709,137 A 1/1998 Blacklock
5,782,147 A 7/1998 Chaconas et al.
5,794,496 A 8/1998 Arnold ..... 81/63.2
5,829,326 A 11/1998 Richner
5,842,391 A 12/1998 Chaconas ..... 81/62
5,857,390 A 1/1999 Whiteford ..... 81/62
5,873,286 A 2/1999 Van Lenten
5,884,538 A 3/1999 Van Lenten
5,901,620 A 5/1999 Arnold ..... 81/63
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann ..... 81/63.2
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart ..... 81/63.2
6,067,882 A * 5/2000 Hillinger ..... 81/63.1
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen ..... 81/63
6,205,889 B1 3/2001 Hsieh
6,209,423 B1 4/2001 Shiao ..... 81/60
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling ..... 81/60
6,257,097 B1 7/2001 I-He
6,260,448 B1 7/2001 Chaconas
6,260,449 B1 7/2001 I-He
6,263,767 B1 7/2001 Hu
6,282,991 B1 9/2001 Hu
6,282,992 B1 9/2001 Hu
6,282,993 B1 9/2001 Forman et al.
6,301,998 B1 10/2001 Hu
6,357,323 B2 * 3/2002 Chi et al. ..... 81/60
6,386,072 B1 * 5/2002 Yuan-Chin et al. ..... 81/63.2
6,408,722 B1 * 6/2002 Chen ..... 81/60
6,431,031 B1 8/2002 Hu ..... 81/63.2
6,435,062 B1 8/2002 McCann ..... 81/63
6,435,063 B1 8/2002 Chen ..... 81/63.2
6,450,066 B1 9/2002 Hu
6,450,068 B1 9/2002 Hu
6,453,779 B2 9/2002 Hu
6,457,387 B1 10/2002 Hu
6,457,388 B1 * 10/2002 Chen ..... 81/63.2
6,457,389 B1 10/2002 Hu
6,488,136 B2 12/2002 Chang ..... 192/46
6,520,051 B1 2/2003 Hu ..... 81/60
6,568,299 B2 * 5/2003 Hu ..... 81/63.2
2001/0035074 A1 11/2001 Hu
2002/0017169 A1 2/2002 Hu
2002/0023519 A1 2/2002 Hu
2002/0023520 A1 2/2002 Hu
2002/0026858 A1 3/2002 Hu
2002/0062718 A1 5/2002 Wang
2002/0088312 A1 7/2002 Ling et al. ..... 81/63.2
2002/0112573 A1 8/2002 Hu ..... 81/63.2
2002/0166416 A1 11/2002 Hu
2002/0166417 A1 11/2002 Hu
2002/0194950 A1 12/2002 Hu
2003/0010159 A1 1/2003 Hu
2003/0010163 A1 1/2003 Hu
2003/0012614 A1 1/2003 Hu
2003/0019335 A1 1/2003 Hu

* cited by examiner

5–5

6-6

7–7

16–16

22–22

27-27

REVERSIBLE RATCHET-TYPE WRENCH

BACKGROUND OF THE INVENTION

1. Field of the Invention

The present invention relates to a reversible ratchet-type wrench. In particular, the present invention relates to a ratchet-type wrench that allows reversible operations without sacrificing the strength of the wrench.

2. Description of the Related Art

Wrenches are an important hand tool and have many types such as spanners, adjusting wrenches, combination wrenches, and socket wrenches. Ring spanners are very useful when the fastener to be tightened/loosened is located in a difficult-to-access place. However, the ring spanners could not be operated in a reverse direction and thus require troublesome disengagement of the ring spanner from the fastener and reengagement of the ring spanner until tightening/loosening of the fastener is achieved. U.S. Pat. No. 6,044,731 to Hsieh issued on Apr. 4, 2000 discloses a double-reversible ratchet wrench that modifies the box end of a ring spanner so as to allow reversible operation of the spanner in both directions. The ratchet wrench comprises a body, a ratchet wheel received in a receiving chamber in an end of the body, a stop block with two toothed portions mounted in the receiving chamber and meshed with the ratchet wheel to limit the direction of rotation of the ratchet wheel, a retainer ring mounted around the ratchet wheel inside the receiving chamber to hold the stop block in place, and an adjusting member mounted in the receiving chamber and turnable to shift the stop block between two positions to control the reversing direction of the ratchet wheel. However, the adjusting member would move together with the retainer ring when the stop block moves during free rotation of the wrench. Further, the adjusting member is attached to the head by a C-shaped clamp, and each of the retainer ring and the C-shaped clamp has a single function. The overall structure has increased number of elements such that the manufacture cost and the assembling time are both increased. Further, the stop block is returned to its initial position by means of cooperation between a pin and a zigzag section of the retainer ring. However, drilling a pin hole for mounting the pin would be extremely difficult for a size 8 mm wrench, and the pin hole weakens the structure of the head of the wrench. Precise processing of the pin hole is required to avoid adverse affection to the sliding and positioning of the stop block in the receiving compartment, which increases the rate of disqualified products and the manufacture cost. Further, the retainer ring and the pin still fail to provide a reliable positioning effect for the stop block; namely, the retainer ring and the pin could not reliably return the stop block to its initial position.

U.S. Pat. No. 6,220,123 to Chen issued on Apr. 24, 2001 discloses a structure of a ratchet wrench comprising a ratchet wheel mounted in a circular opening of a wrench head of a common ratchet, and a cavity is provided in the circular opening adjacent to one side of the rod body of the wrench for mounting a restrictive teeth structure. The end terminal of the cavity is provided with a ball hole to contain a spring and a steel ball, and the restrictive teeth structure is urged by the steel ball to thereby control the high-torque movement of the ratchet wheel. A rotating disc is used to cover the opening and includes ratchet teeth for meshing top ratchet teeth of the restrictive teeth structure. However, the formation of top and bottom ratchet: teeth on a side of the restrictive teeth structure would not be easy, and this decreases the torque-bearing capacity of the ratchet wrench, as the meshing area between the restrictive teeth structure and the ratchet wheel is reduced. Further, the restrictive teeth structure could not be reliably positioned, as there is no positioning means provided between the rotating disc and the wrench body. As a result, the rotating disc moves together with the restrictive teeth structure when the ratchet wrench turns freely. Further, since the top ratchet teeth of the restrictive teeth structure meshes with the ratchet teeth of the rotating disc and the bottom ratchet teeth of the rotating disc meshes with the ratchet teeth of the ratchet wheel, the ratchet wrench must be disengaged from the fastener before switching of the ratcheting direction through rotation of the rotating disc. Further, the engaging force between the ratchet wheel and the rotating disc provided by a C-shaped fastening ring was found poor. As a result, the ratchet wheel and the rotating disc could fly away from the wrench body when the ratchet wrench is subject to a relatively high torque.

It is, therefore, a need in a ratchet wrench that allows reversible operation without sacrificing the strength of the ratchet wrench and the torque-bearing capacity.

SUMMARY OF THE INVENTION

A wrench in accordance with the present invention comprises:

a handle;

a head extending from the handle and including a hole, a peripheral wall defining the hole of the head including a compartment, an annular groove being defined in an end of the peripheral wall defining the hole, the annular groove being partially coincident with the compartment;

a drive member rotatably mounted in the hole of the head and including a plurality of teeth in an outer periphery thereof;

a pawl slidably received in the compartment and including a first side having a plurality of teeth and a second side opposite to the first side, the pawl further including a first engaging member formed thereon;

a pressing member mounted in the compartment;

an elastic element mounted in the compartment for urging the pressing member to press against the second side of the pawl for engaging the teeth of the pawl with the teeth of the drive member;

a switching member having a first end mounted in the hole of the head and a second end outside the head for manual operation, the first end of the switching member including an annular groove in an outer periphery thereof, the switching member further including a second engaging member for engaging with the first engaging member of the pawl; and a retainer ring partially engaged in the annular groove of the switching member and partially engaged in the annular groove of the head, the retainer ring being retained in place by a wall defining the compartment;

one of the switching member and the retainer ring including two retaining sections, and the other of the switching member and the retainer ring including a third engaging member for selectively engaging with one of the retaining sections;

wherein the second end of the switching member being manually turnable to make the third engaging member engage with one of the retaining sections and to move the pawl through engagement between the first engaging member and the second engaging member;

wherein the first engaging member and the second engaging member are so configured that the switching member is not moved when the pawl moves as a result of free rotation of the wrench.

Other objects, advantages, and novel features of the invention will become more apparent from the following detailed description when taken in conjunction with the accompanying drawings.

BRIEF DESCRIPTION OF THE INVENTION

DETAILED DESCRIPTION OF THE INVENTION EMBODIMENTS

Figure 1:
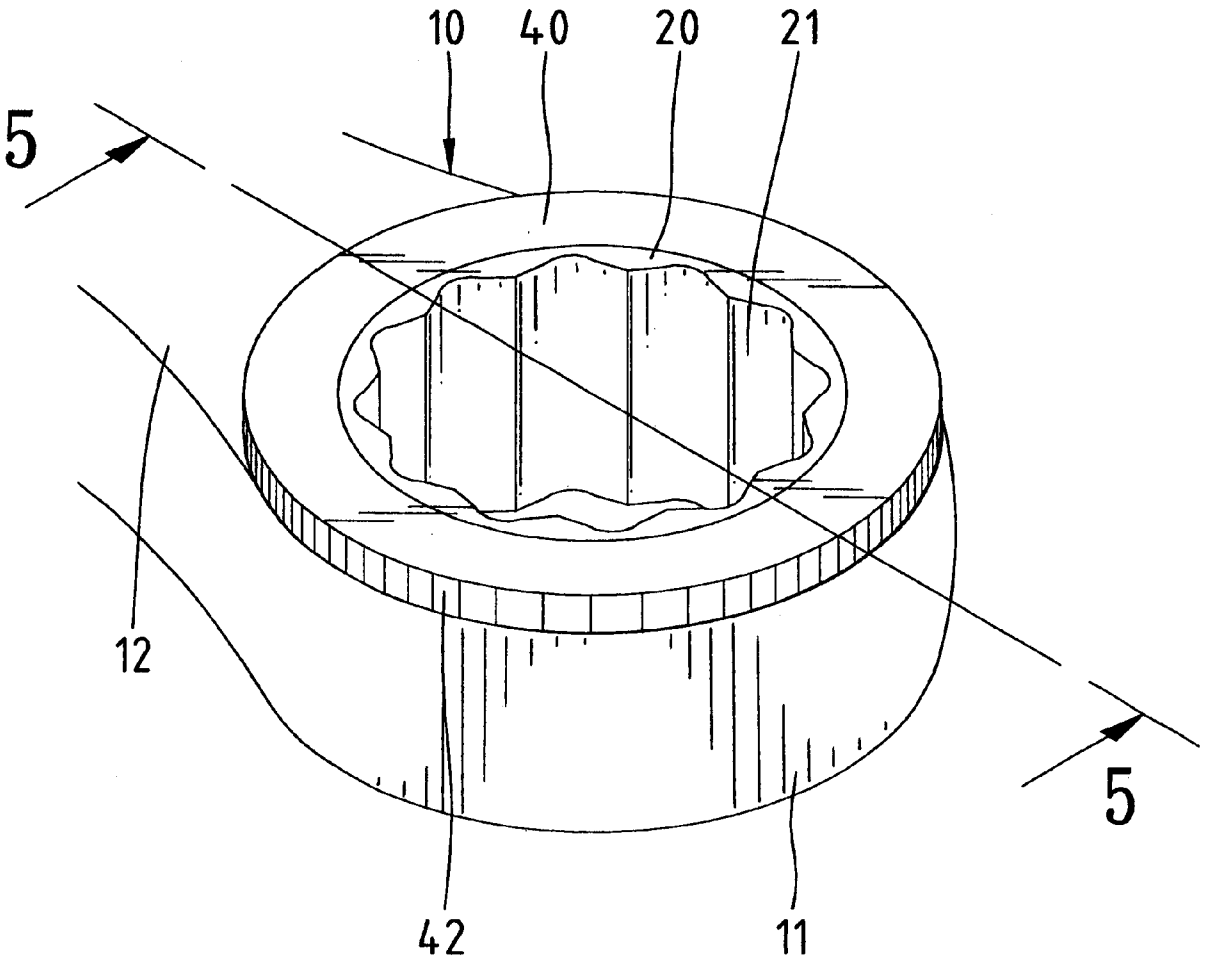
FIG. 1 is a perspective view of a first embodiment of a reversible ratchet-type wrench in accordance with the present invention.
Figure 2:
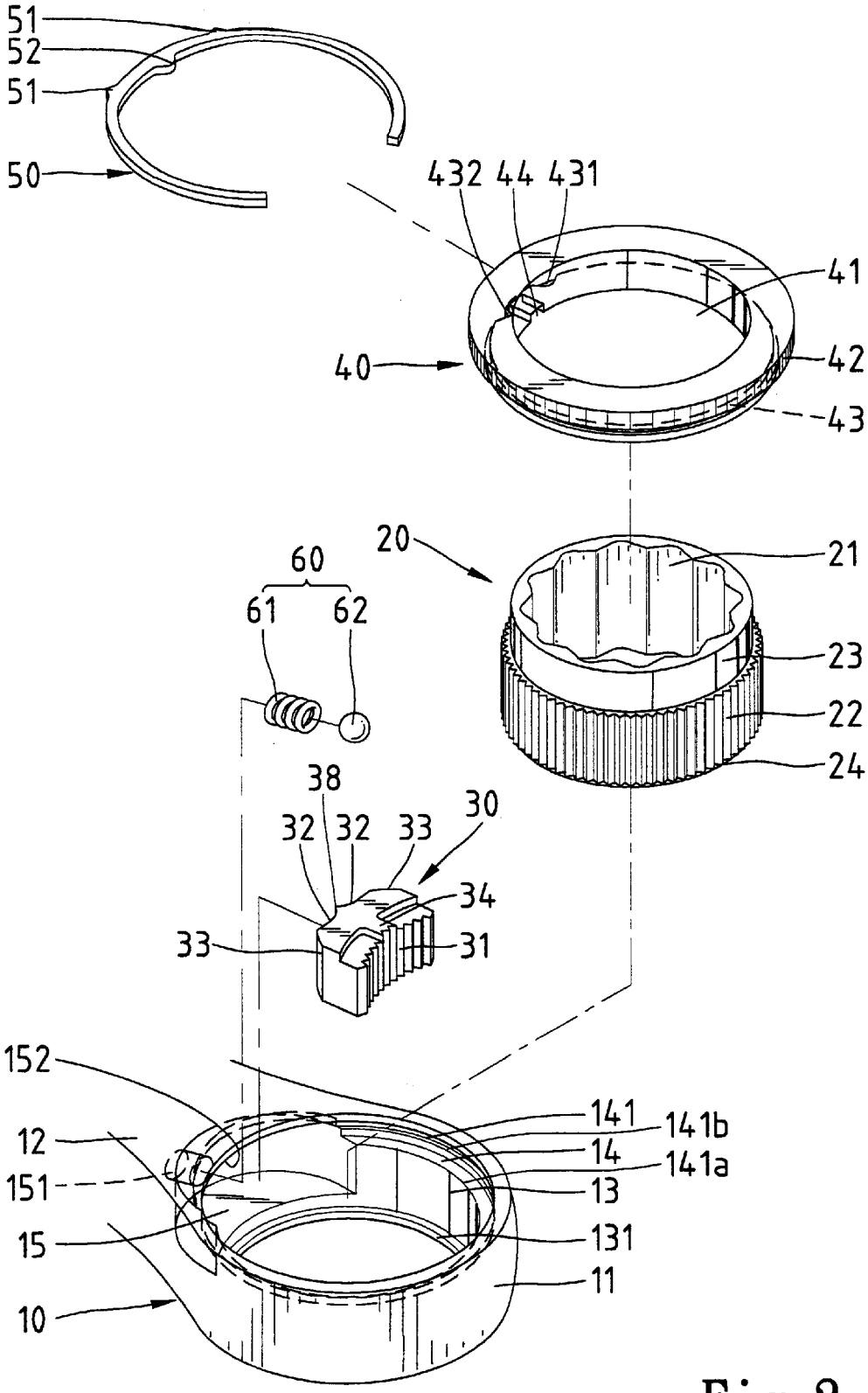
FIG. 2 is an exploded perspective view of the wrench in FIG. 1.
Figure 3:
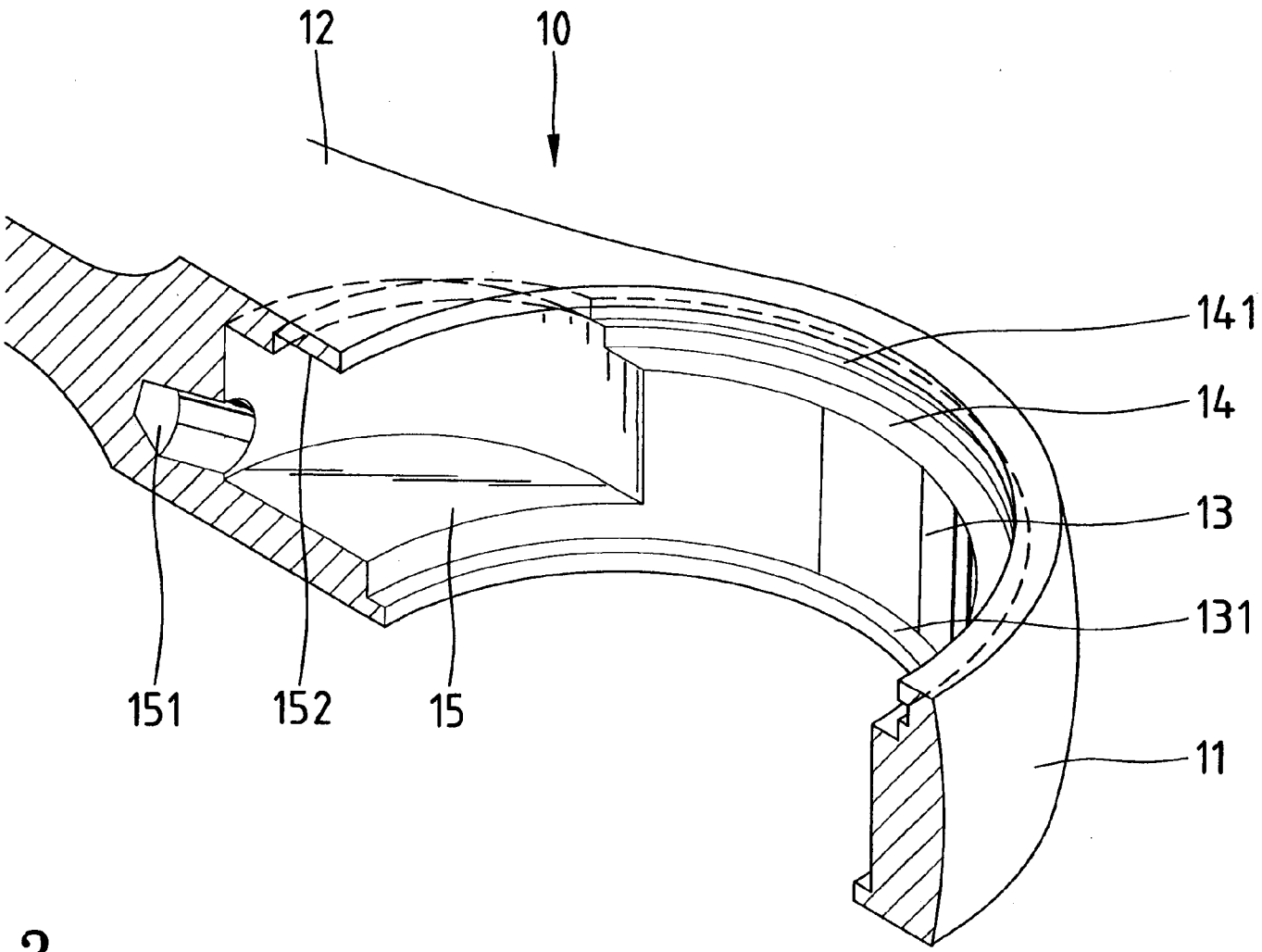
FIG. 3 is a partly-cutaway perspective view illustrating a head of the wrench in FIG. 1.

Referring to FIGS. 1 through 3, a first embodiment of a ratchet-type reversible wrench in accordance with the present invention is designated by "10" and generally comprises a handle 12 and a head 11 extending from the handle 12. A hole 13 is defined in the head 11 and a stepped portion 14 is formed on an end (the upper one in FIG. 2) of a peripheral wall defining the hole 13. Preferably, the diameter of an inner section 141*a* of the stepped portion 14 is greater than that of an outer section 141*b* of the stepped portion 14 for easy installation of a switching member (e.g., a switching ring 40), which will be described later. An annular groove 141 is defined in a wall defining the outer section 141*b* of the stepped portion 14. A compartment 15 is defined in a peripheral wall defining the hole 13, and a cavity 151 is defined in a wall defining the compartment 15. An annular ledge 131 projects inward from the other end (the lower one in FIG. 2) of the peripheral wall defining the hole 13. Further, an end (the upper one in FIG. 2) of the compartment 15 has a stepped portion 152 and is partially coincident with the stepped portion 14, best shown in FIG. 3.

A drive member 20 is rotatably mounted in the hole 13 of the head 11. In this embodiment, the drive member 20 is a gear wheel including a plurality of teeth 22 in an outer periphery thereof. The outer periphery of the gear wheel 20 includes a reduced first end 23 and a reduced second end 24. Preferably, the reduced first end 23 is longer than the reduced second end 24 in an axial direction of the gear wheel 20. Further, the gear wheel 20 includes an inner periphery for driving a fastener (not shown). When the gear wheel 20 is received in the hole 13 of the head 11, the reduced second end 24 of the gear wheel 20 rests on the annular ledge 131 of the head 11, thereby preventing falling of the gear wheel 20.

A pawl 30 is slidably mounted in the compartment 15 and includes a first side having a plurality of teeth 31 and a second side opposite to the first side. Two retaining grooves 32 are defined in the second side of the pawl 30 and spaced by a ridge 38. The pawl 30 further includes two pressing ends 33 for pressing against a wall defining the compartment 15. Further, the first side of the pawl 30 includes two recessed areas in an end section (the upper one in FIG. 2) to thereby define a protrusion 34.

Mounted in the cavity 151 is a biasing means 60 comprised of an elastic element 61 and a pressing member (e.g., a ball 62). The ball 62 is biased by the elastic element 61 to be selectively engaged in one of the retaining grooves 32 of the pawl 30, thereby selectively urging one of the pressing ends 33 of the pawl 30 to press against the wall defining the compartment 15 and urging the teeth 31 of the pawl 30 to engage with the teeth 22 of the gear wheel 20.

Figure 4:
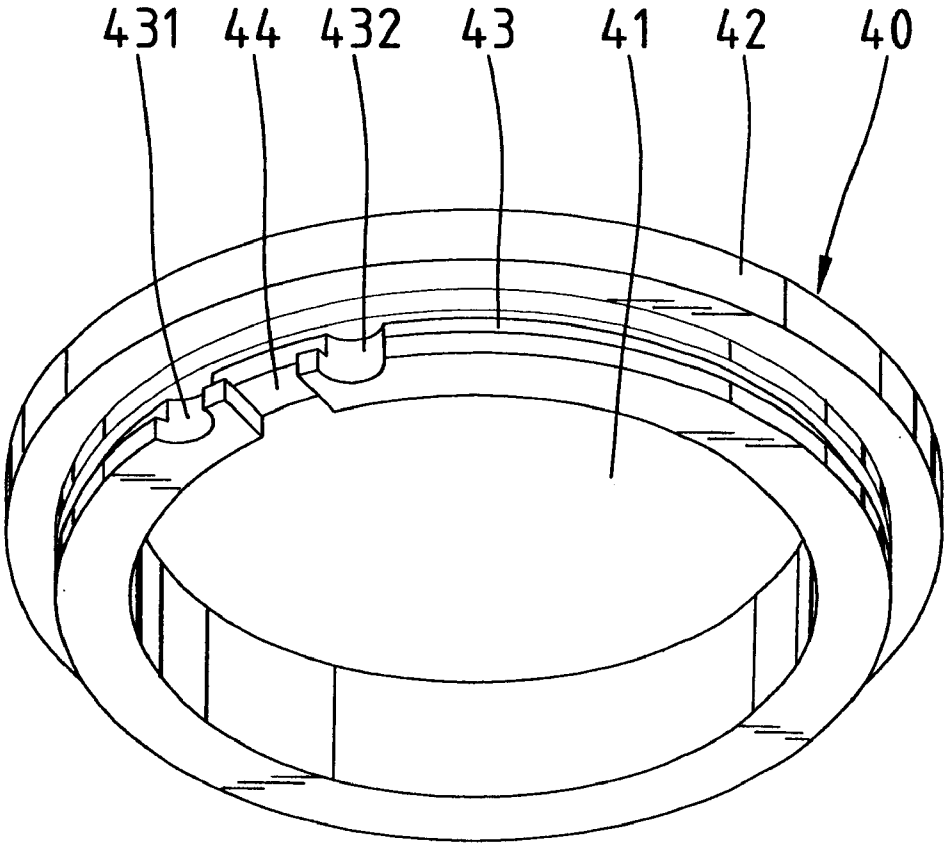
FIG. 4 is a bottom perspective view of a switching ring of the wrench in FIG. 1.
Figure 5:
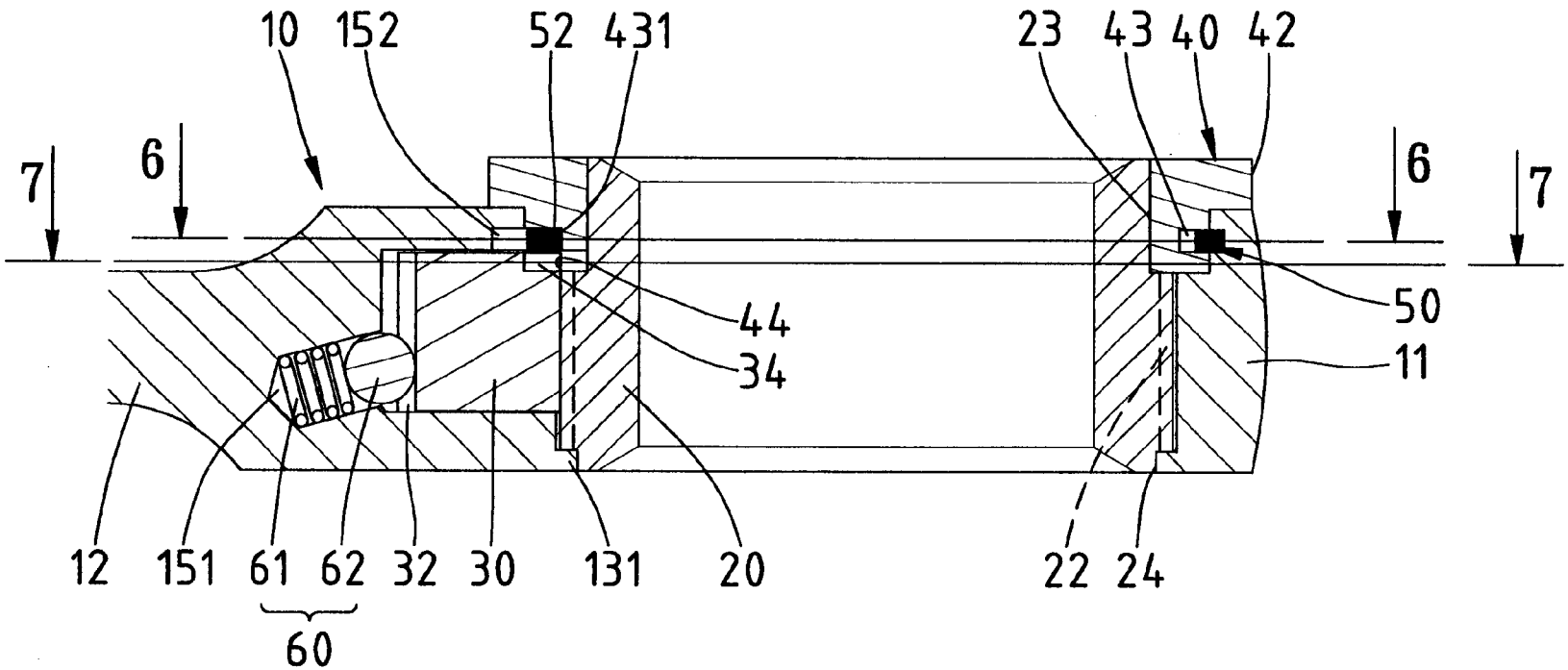
FIG. 5 is a sectional view taken along plane 5—5 in FIG. 1.

Referring to FIGS. 1, 2, and 4, the switching member (i.e., the switching ring 40 in this embodiment) includes a central hole 41. A flange 42 is formed on an end of the switching ring 40, and an annular groove 43 is defined in a middle portion of the outer periphery of the switching ring 40. Further, a notch 44 is defined in the other end of switching ring 40, and two recessed retaining sections 431 and 432 are formed on two sides of the notch 44 and extended to the annular groove 43. The switching ring 40 is mounted around the recessed first portion 23 of the gear wheel 20 with the flange 42 of the switching ring 40 being located outside the head 11 for manual turning. Further, the other end of the switching ring 40 abuts against the stepped portion 14 of the head 11, and the protrusion 34 of the pawl 30 is received in the notch 44 of the switching ring 40. The notch 44 is wider than the protrusion 34 of the pawl 30.

A substantially C-shaped retainer ring 50 (e.g., a C-clip) includes two spaced outer protuberances 51 on an outer periphery thereof and an inner protuberance 52 on an inner periphery thereof and located between the outer protuberances 51. It is noted that the outer periphery of the retainer ring 50 is not an arc in a section between the outer protuberances 51. Preferably, the section of the outer periphery of the retainer ring 50 between the outer protuberances 51 is chamfered. The retainer ring 50 is partially engaged in the annular groove 43 of the switching ring 40 and partially engaged in the annular groove 141 of the head 11. Thus, disengagement of the switching ring 40 is prevented. Further refer to FIG. 6. The outer protuberances 51 are respectively positioned by two ends of the stepped portion 152 of the compartment 15 to thereby prevent rotation of the retainer ring 50 relative to the wrench 10. Further, the inner protuberance 52 is selectively engaged in one of the first retaining section 431 and the second retaining section 432 of the switching ring 40, thereby positioning the switching ring 40.

Figure 6:
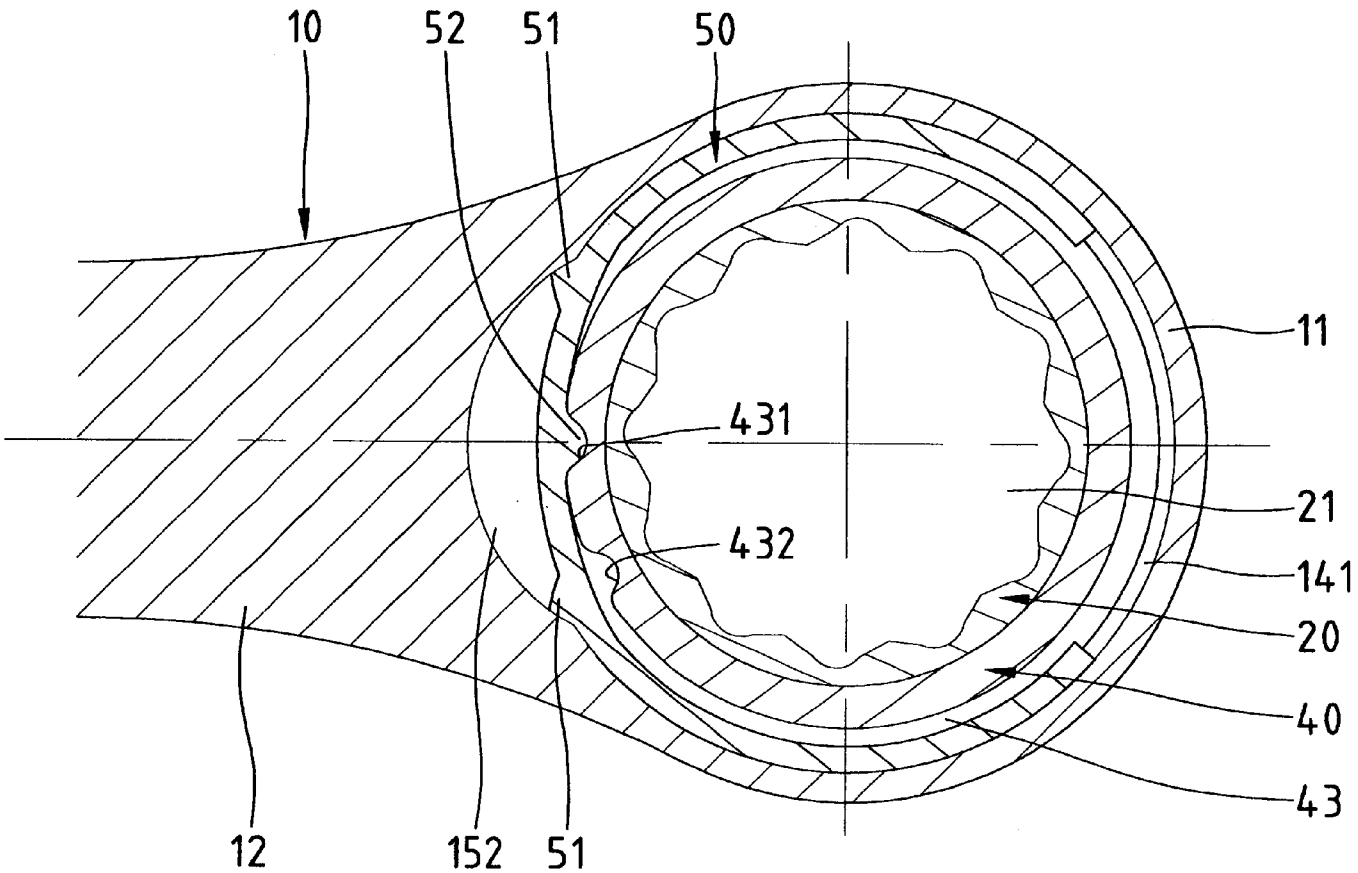
FIG. 6 is a sectional view taken along plane 6—6 in FIG. 5.
Figure 7:
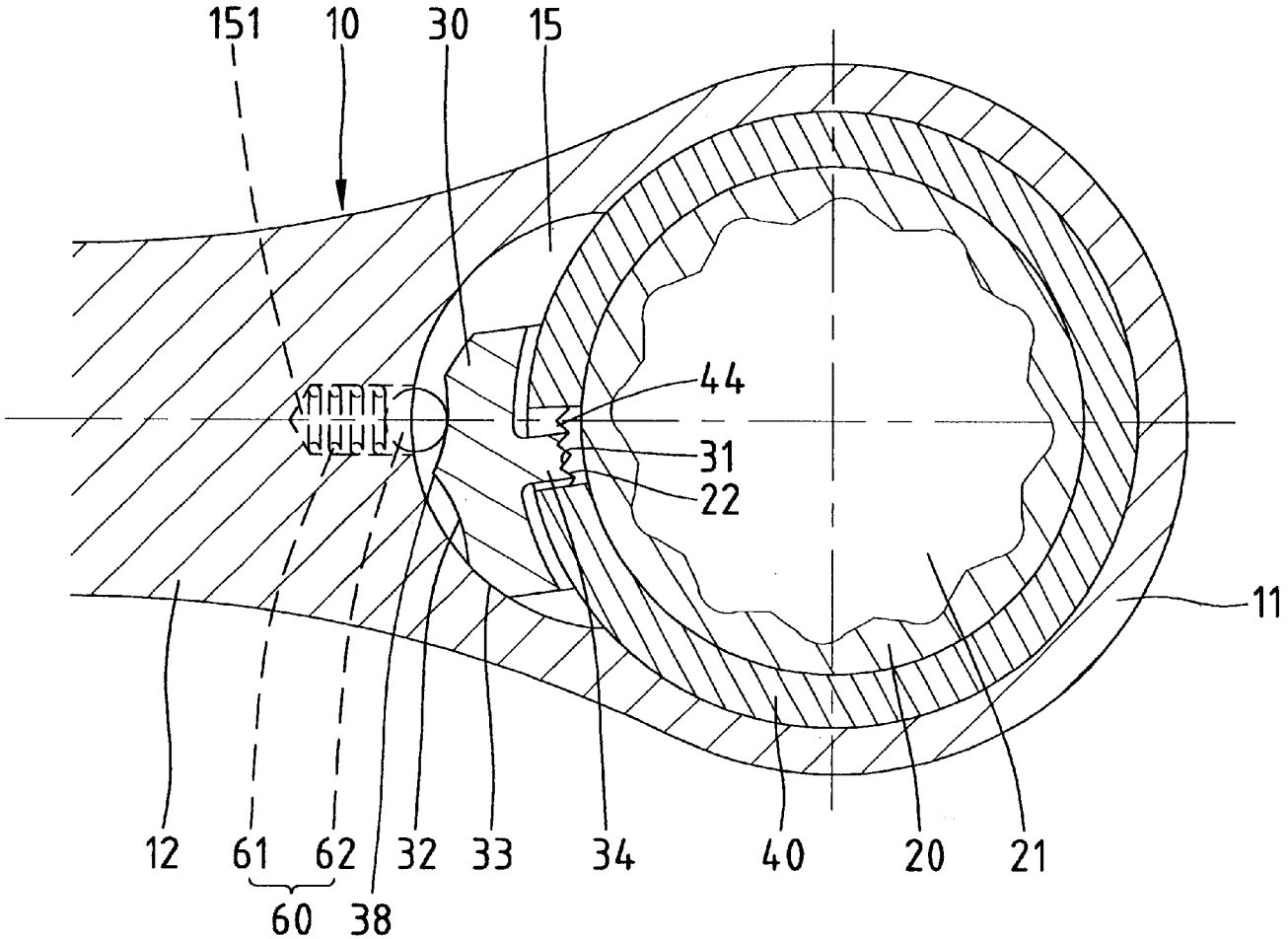
FIG. 7 is a sectional view taken along plane 7—7 in FIG. 5.

Still referring to FIG. 6, the outer protuberances 51 are respectively positioned by two ends of the stepped portion 152 of the compartment 15, the inner protuberance 52 of the retainer ring 50 is engaged in the first retaining section 431 of the switching ring 40 to thereby reliably position the switching ring 40 in place. Referring to FIG. 7, the protrusion 34 of the pawl 30 is engaged in the notch 44 of the switching ring 40 such that the pawl 30 is located in a lower portion (as viewed from FIG. 7) of the compartment 15 with one of the pressing ends 33 (the lower one in FIG. 7) of the pawl 30 pressing against a lower portion of the wall defining the compartment 15. Still referring to FIG. 7, a fastener (not shown) in the gear wheel 20 can be driven when the wrench is turned clockwise.

Figure 8:
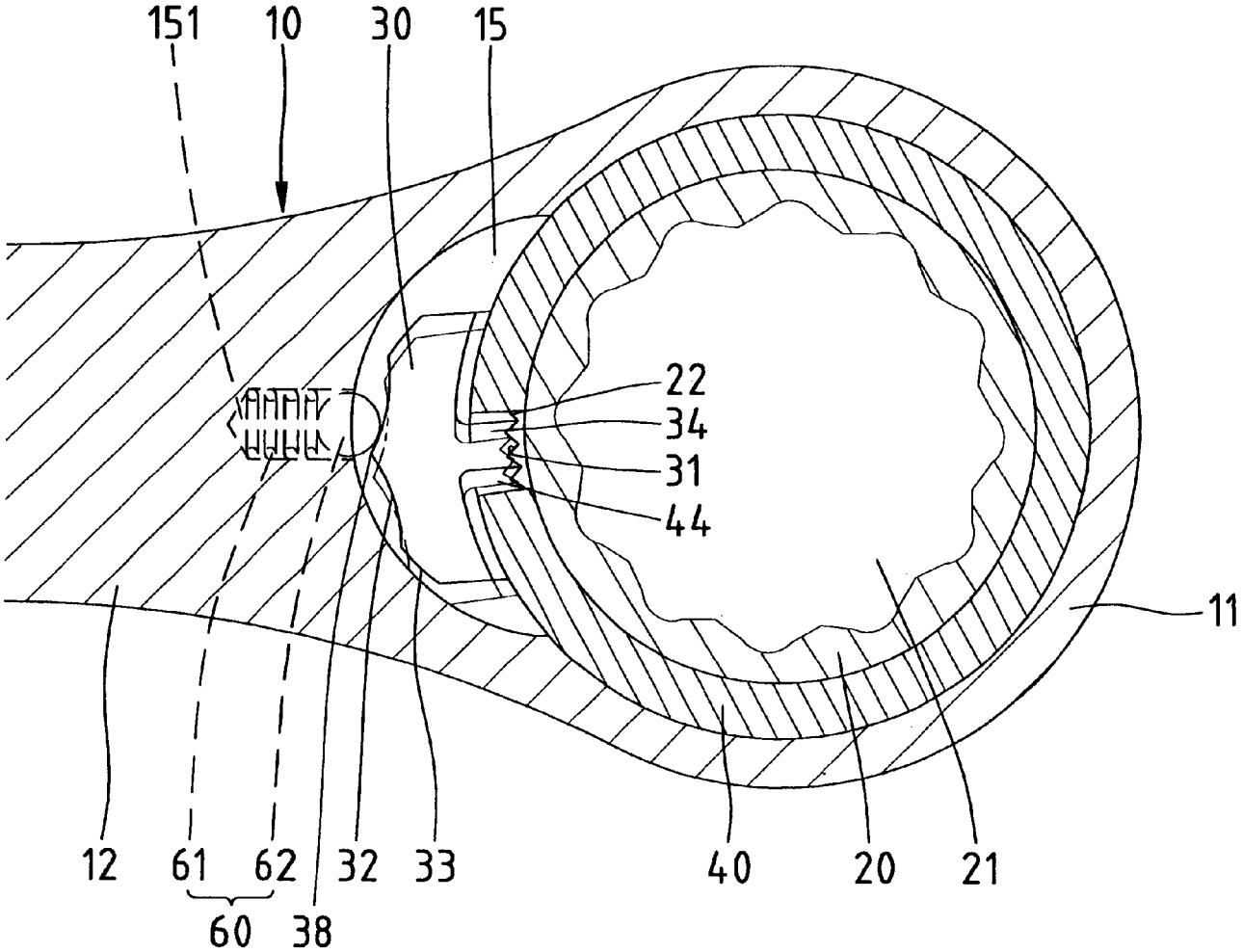
FIG. 8 is a sectional view similar to FIG. 7, illustrating free rotation of the ratchet wheel.

FIG. 8 illustrates movement of the pawl 30 during free rotation of the wrench 10. Namely, when the wrench is turned counterclockwise, the pawl 30 slides away from the gear wheel 20 and then reengages with the gear wheel 20 under the action of the biasing means 60. The procedure repeats and thus causes free rotation of the gear wheel 20; namely, the fastener (not shown) in the gear wheel is not turned, as the gear wheel 20 is not driven by the pawl 30. Since the notch 44 of the switching ring 40 is wider than the protrusion 34 of the pawl 30 and since the protrusion 34 is located on a right portion of the notch 44, the notch 44 provides a space largely enough to allow sliding movement of the protrusion 34 without causing the switching ring 40 to move during free rotation of the wrench. Further, the switching ring 40 is retained in place by the retainer ring 50 and thus would not turn relative to the wrench 10.

Figure 9:
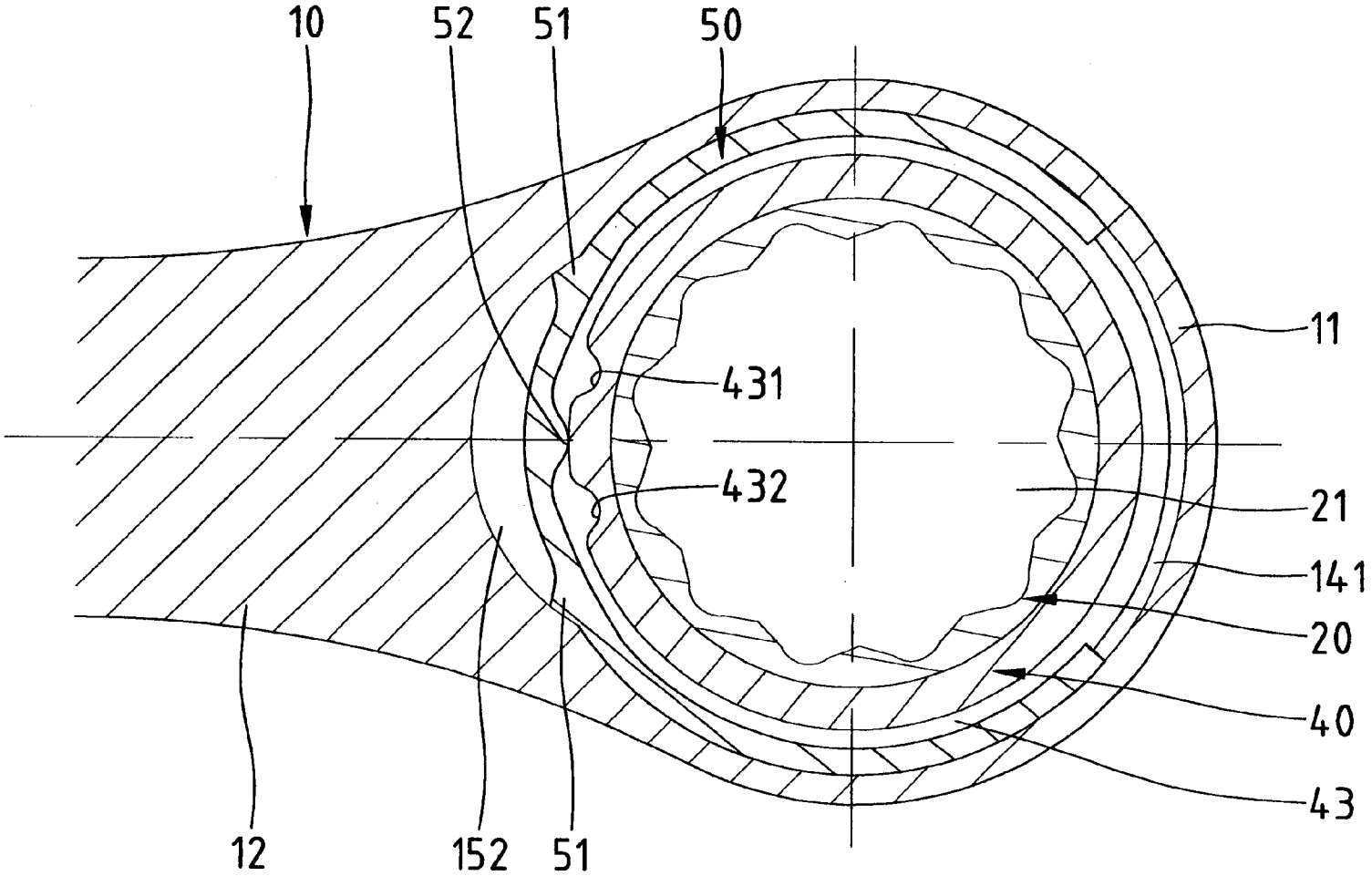
FIG. 9 is a sectional view similar to FIG. 6, illustrating a transition position of the switching ring of the wrench during switching, of the ratcheting direction.
Figure 10:
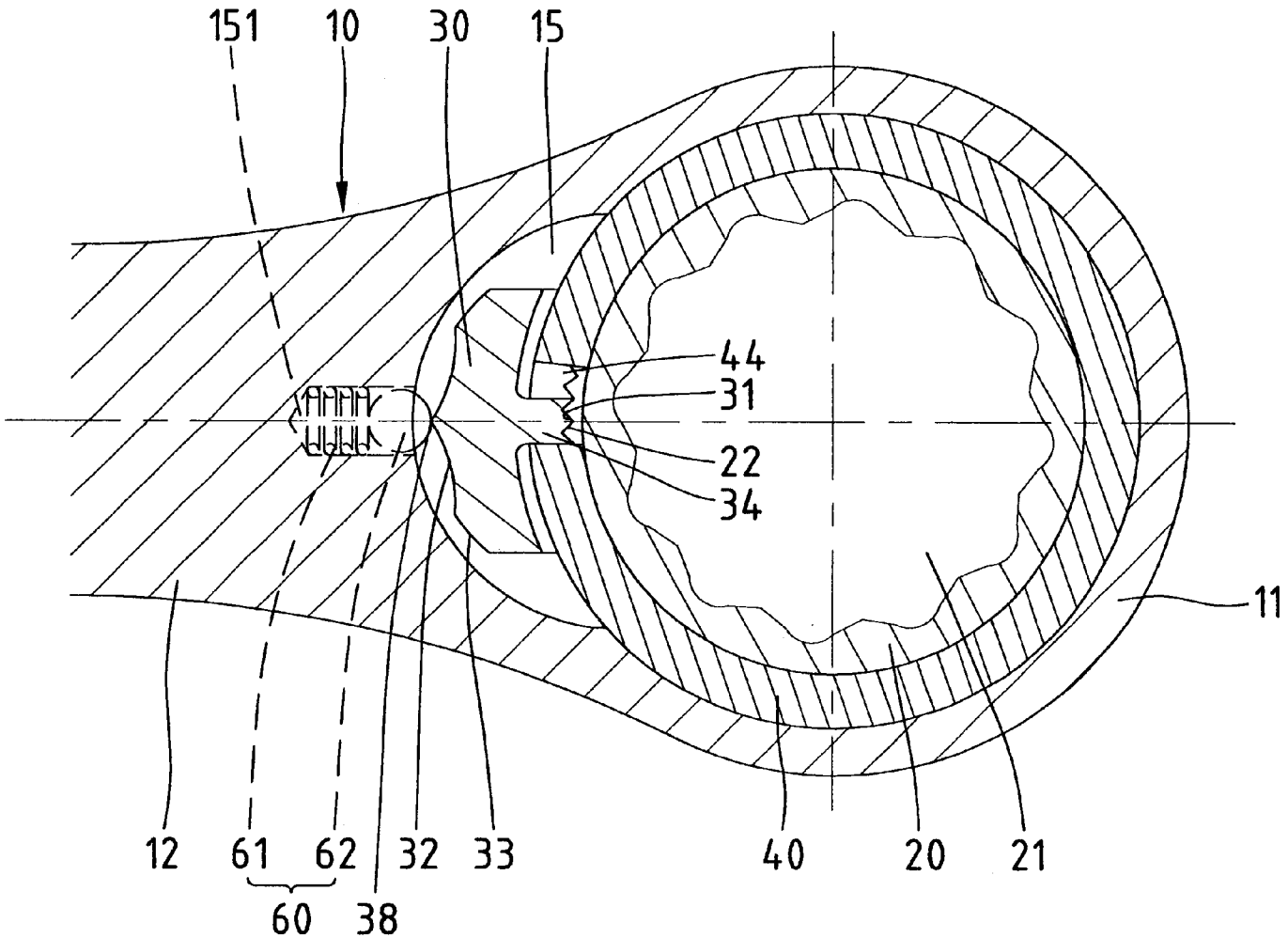
FIG. 10 is a sectional view similar to FIG. 7, illustrating a transition position of a pawl of the wrench during switching of the ratcheting direction.
Figure 11:
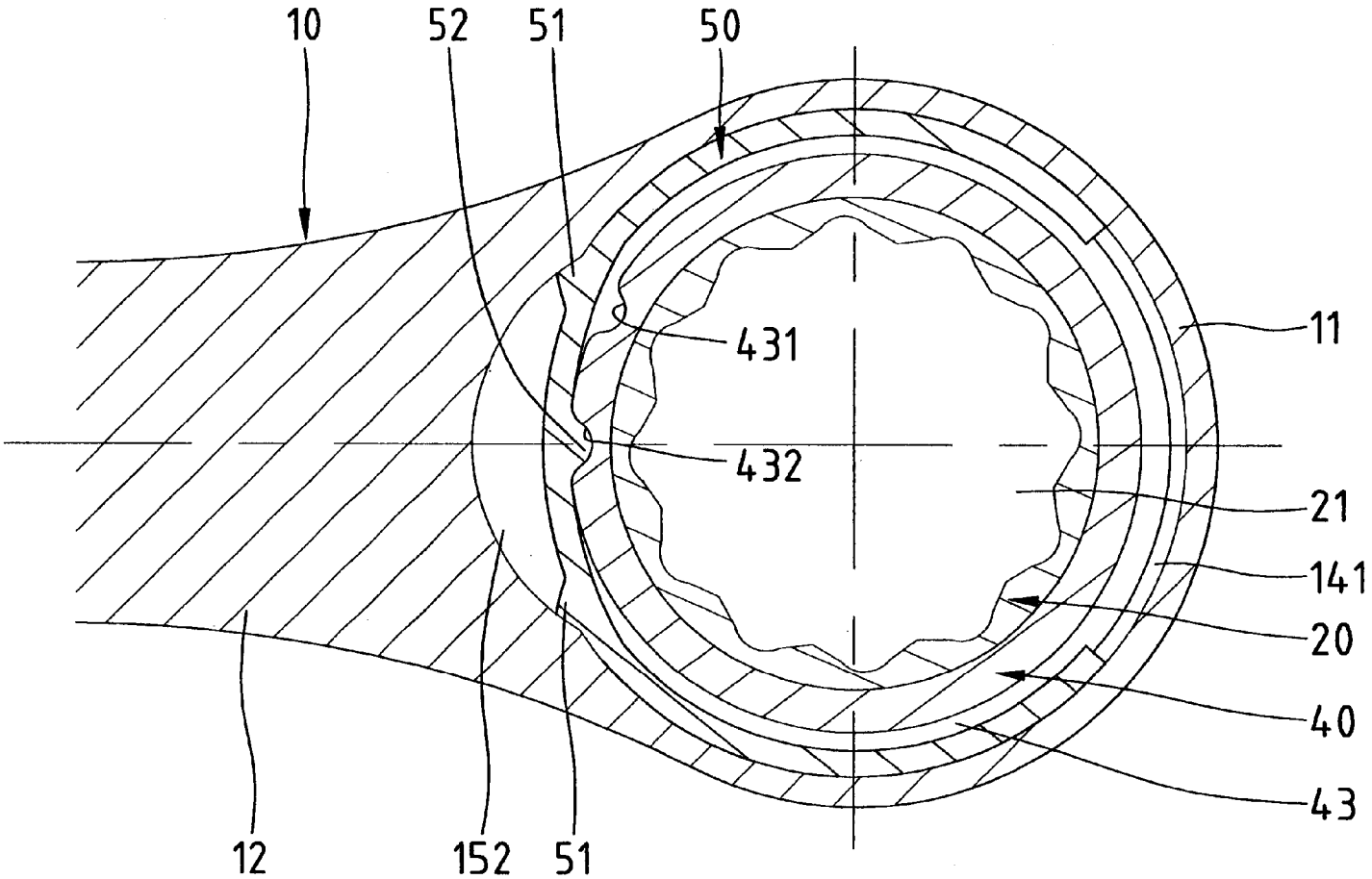
FIG. 11 is a sectional view similar to FIG. 6, illustrating a final position of the switching ring of the wrench after switching of the ratcheting direction.
Figure 12:
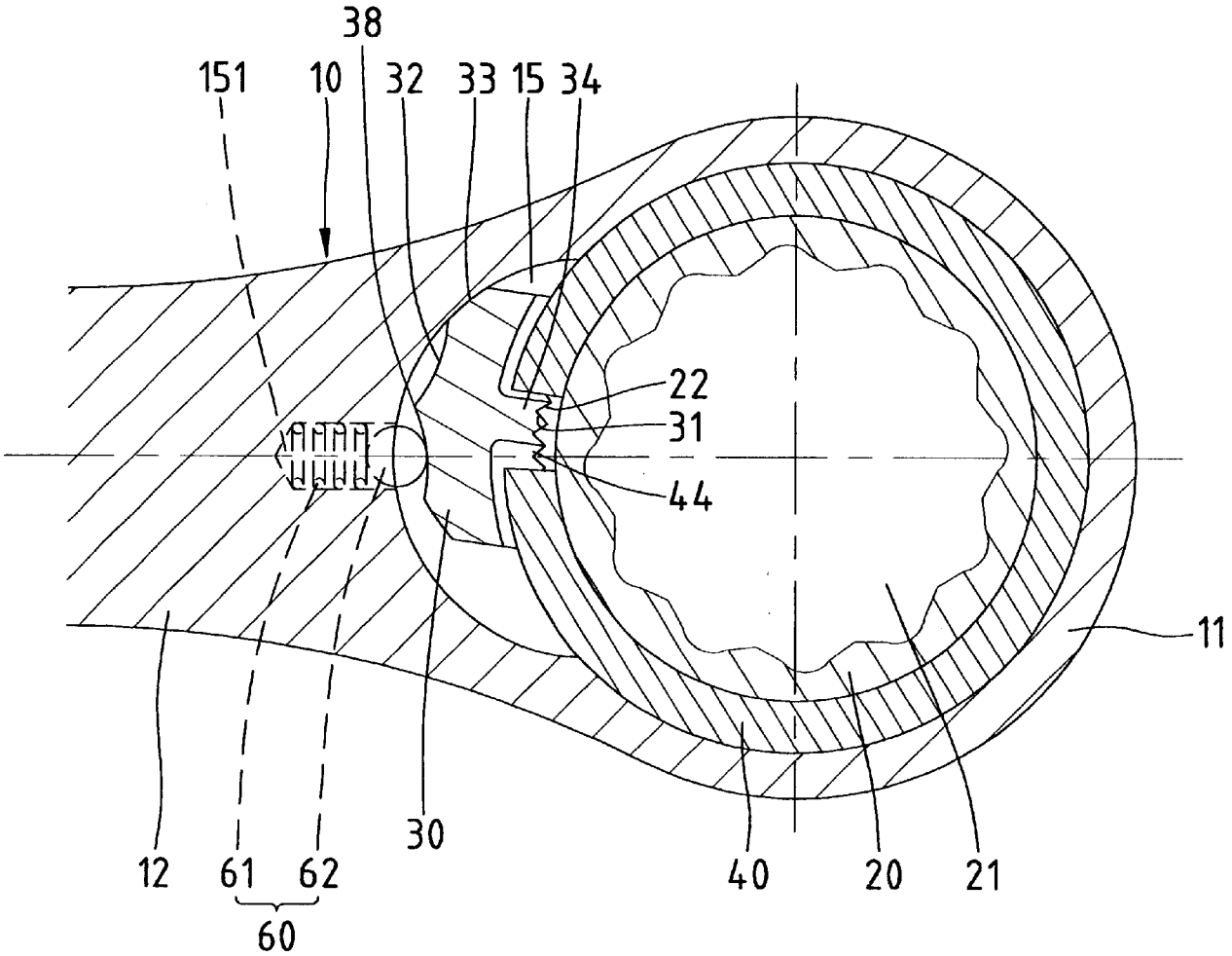
FIG. 12 is a sectional view similar to FIG. 7, illustrating a final position of the pawl of the wrench after switching of the ratcheting direction.

Referring to FIGS. 9 and 10, when switching of the ratcheting direction of the wrench is required, the flange 42 of the switching ring 40 is turned, e.g., clockwise to disengage the first retaining section 431 of the switching ring 40 from the inner protuberance 52 of the retainer ring 50 until the inner protuberance 52 is engaged in the second retaining section 432 of the switching ring 40, as shown in FIG. 11. It is noted that the pawl 30 moves together with the switching ring 40 when the protrusion 34 of the pawl 30 is located in the lower portion of the notch 44 of the switching ring 40, and the ball 62 moves across the ridge 38 (FIG. 10) and is then engaged in the other retaining groove 32 of the pawl 30 (FIG. 12). As illustrated in FIG. 12, the pawl 30 is moved to the upper portion of the compartment 15 with the other pressing end 33 pressing against another portion of the wall defining the compartment 15. It is noted that the protrusion 34 of the pawl 30 is now located in an upper portion of the notch 44 of the switching ring 40, allowing sliding movement of the pawl 30 without causing movement of the switching ring 40 during counterclockwise free rotation of the wrench 10. It is noted that the section of the retainer ring 50 between the outer protuberances 51 is slightly moved backward during switching of the ratcheting direction, and the section restores its shape after completion of the switching of the ratcheting direction.

Figure 13:
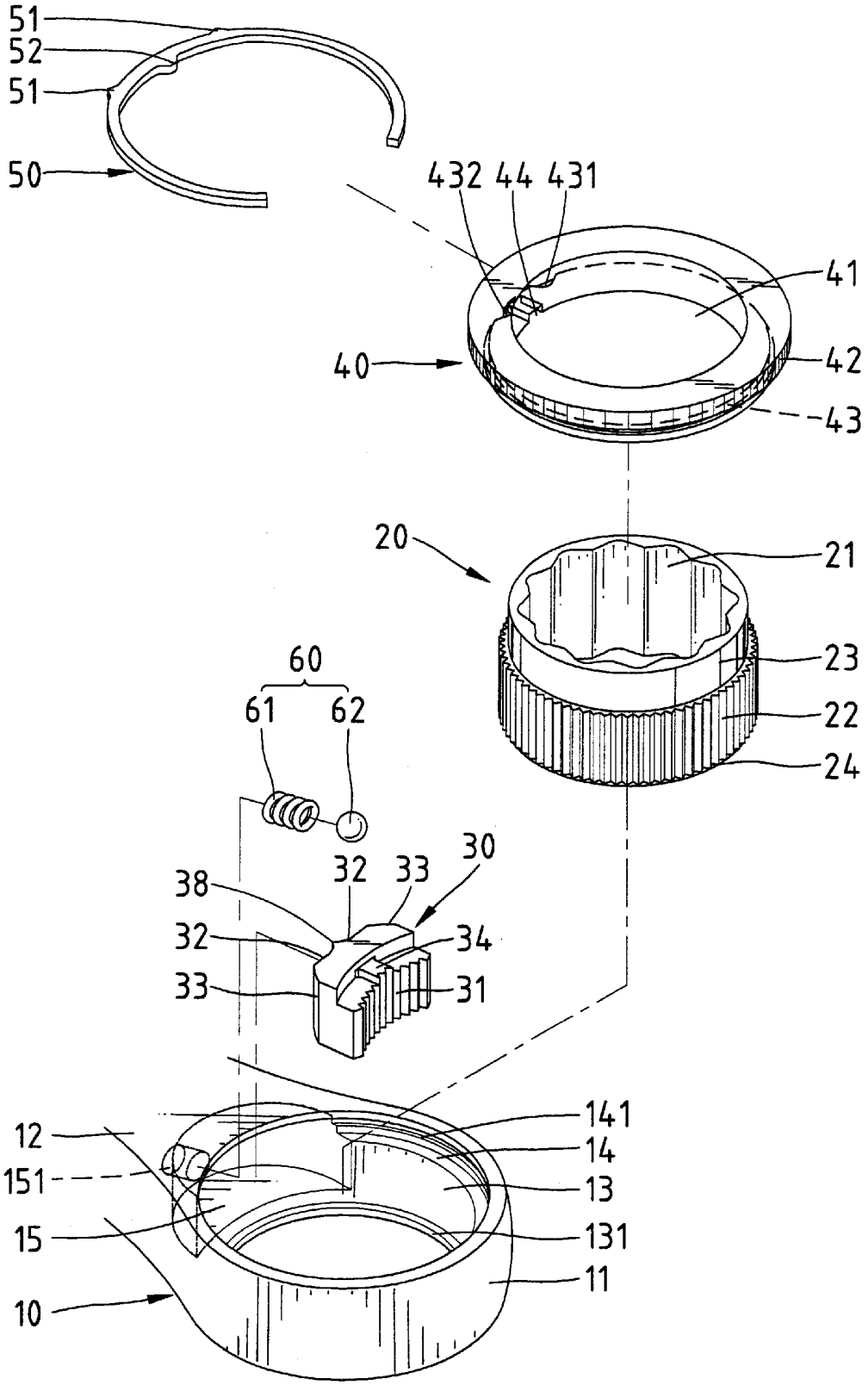
FIG. 13 is an exploded perspective view of a second embodiment of the reversible ratchet-type wrench in accordance with the present invention.
Figure 14:
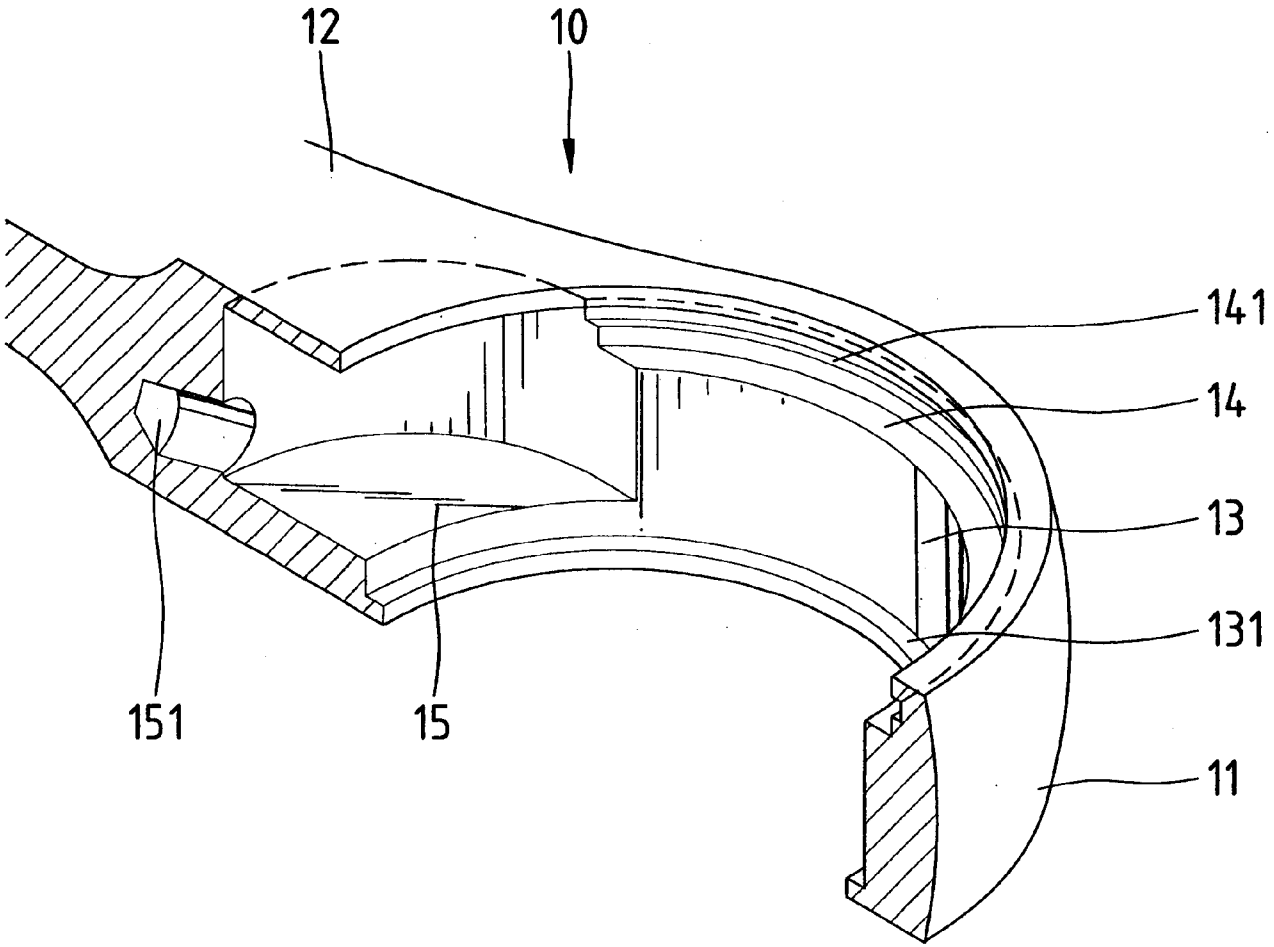
FIG. 14 is a partly-cutaway perspective view illustrating a head of the wrench in FIG. 13.
Figure 15:
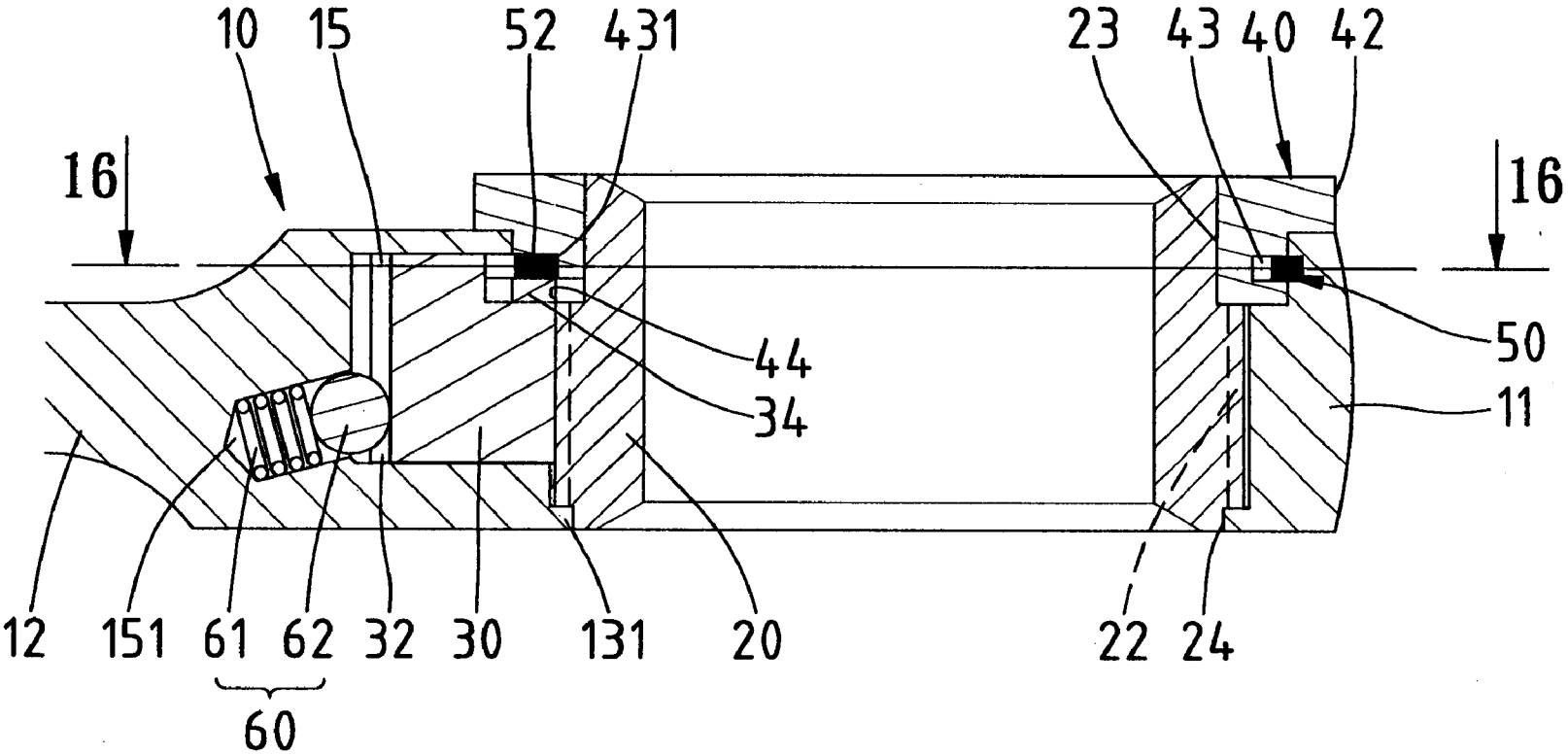
FIG. 15 is a sectional view of the wrench in FIG. 13.
Figure 16:
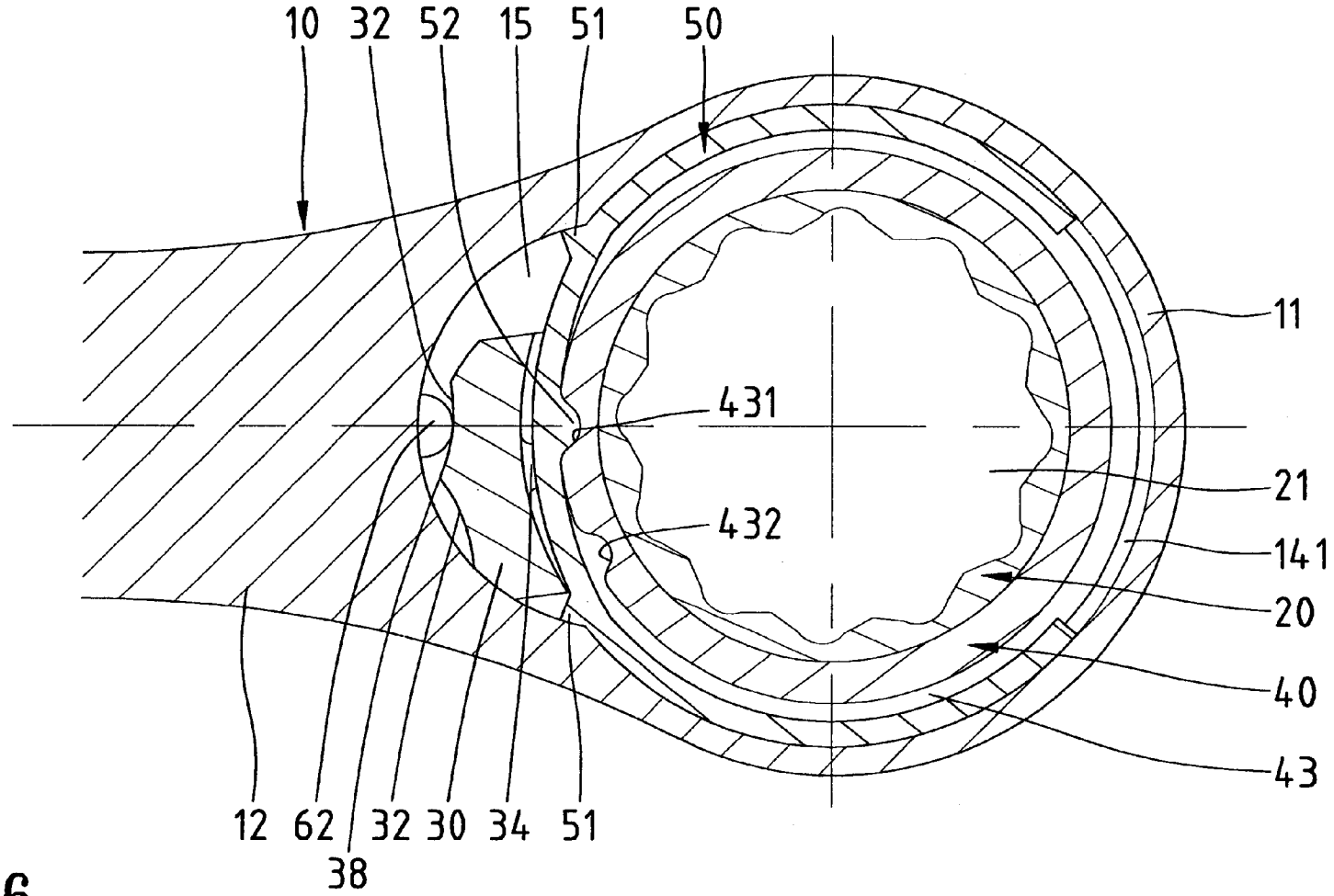
FIG. 16 is a sectional view taken alone plane 16—16 in FIG. 15.

FIGS. 13–18 illustrate a second embodiment of the invention, wherein like numerals denote like elements. In this embodiment, the stepped portion 152 of the compartment 15 is omitted, and the upper end of the compartment 15 is partially coincident with the stepped portion 14, best shown in FIG. 14. The protrusion 34 of the pawl 30 is located at a level lower than an upper side of the pawl 30; namely, the height of the left portion of the pawl 30 in FIG. 13 is increased in response to the change in the height of the compartment 15. Thus, the engaging area between each pressing end 33 of the pawl 30 and the wall defining the compartment 15 is increased to thereby enhance the pressing effect. The outer protuberances 51 of the retainer ring 50 are respectively positioned by two ends of the upper portion of the compartment 15 to thereby retain the retainer ring 50 in the wrench 10, best shown in FIG. 16. The inner protuberance 52 of the retainer ring 50 is engaged in, e.g., the first retaining section 431 of the switching ring 40, thereby reliably positioning the switching ring 40 in place. It is noted that the pawl 30 is located in a lower portion of the compartment 15. The wrench in FIG. 16 allows clockwise ratcheting and counterclockwise free rotation. It is noted that the section: of the retainer ring 50 between the outer protuberances 51 is slightly moved backward during switching of the ratcheting direction, and the section restores its shape after completion of the switching of the ratcheting direction.

Figure 17:
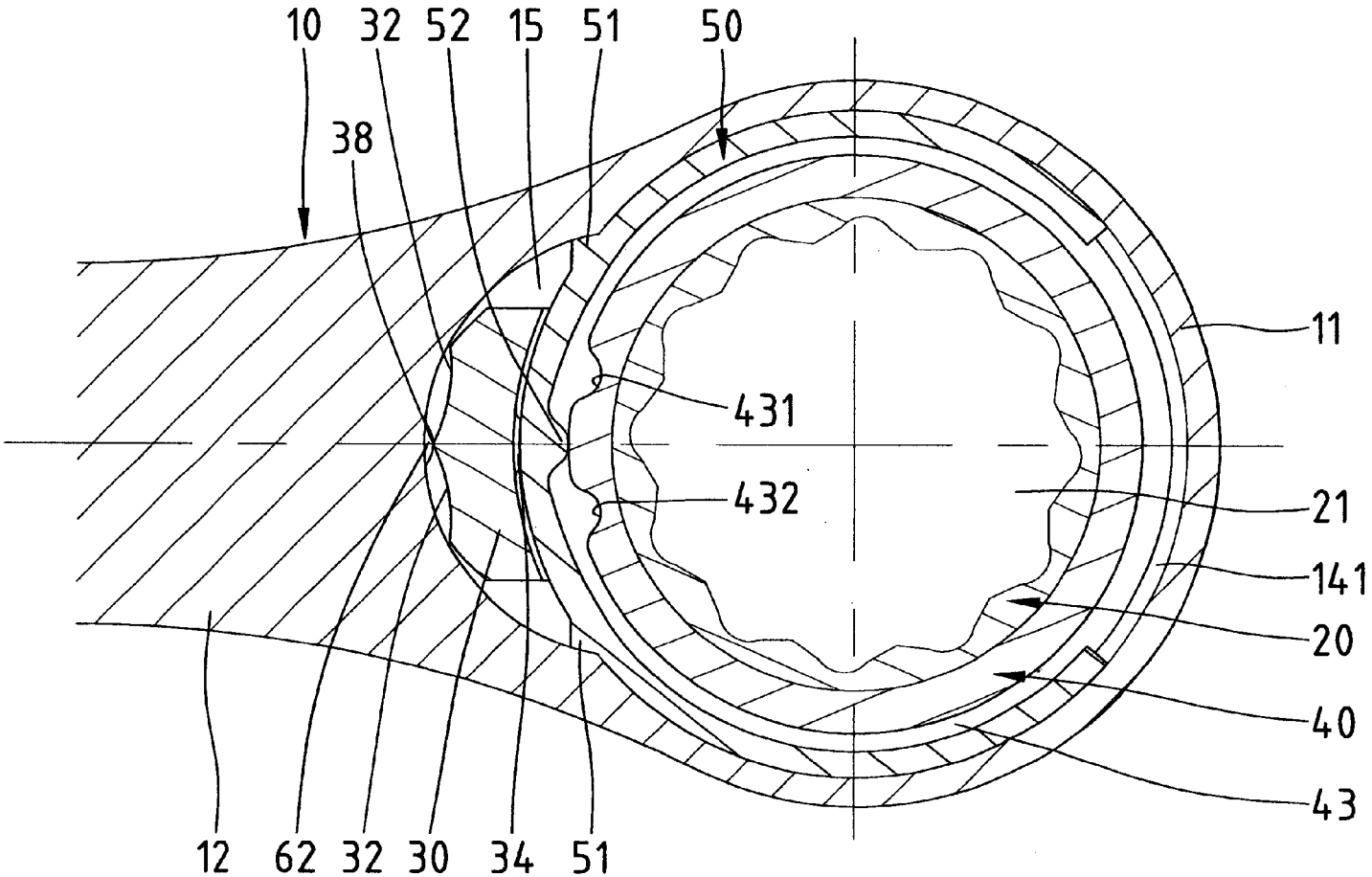
FIG. 17 is a sectional view similar to FIG. 16, illustrating a transition position of the pawl of the wrench.
Figure 18:
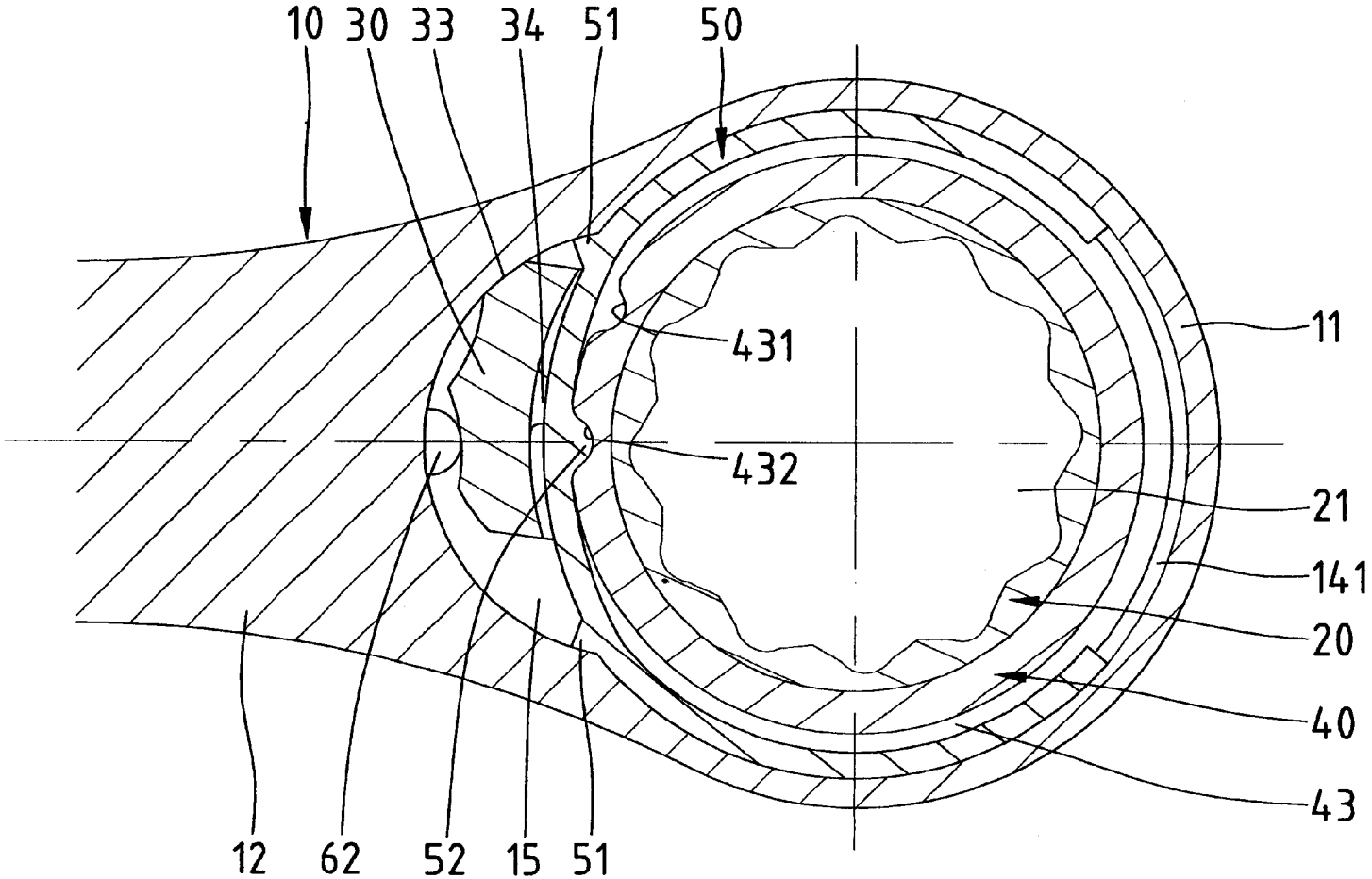
FIG. 18 is a sectional view similar to FIG. 16, illustrating a final position of the pawl of the wrench after switching of the ratcheting direction.
Figure 19:
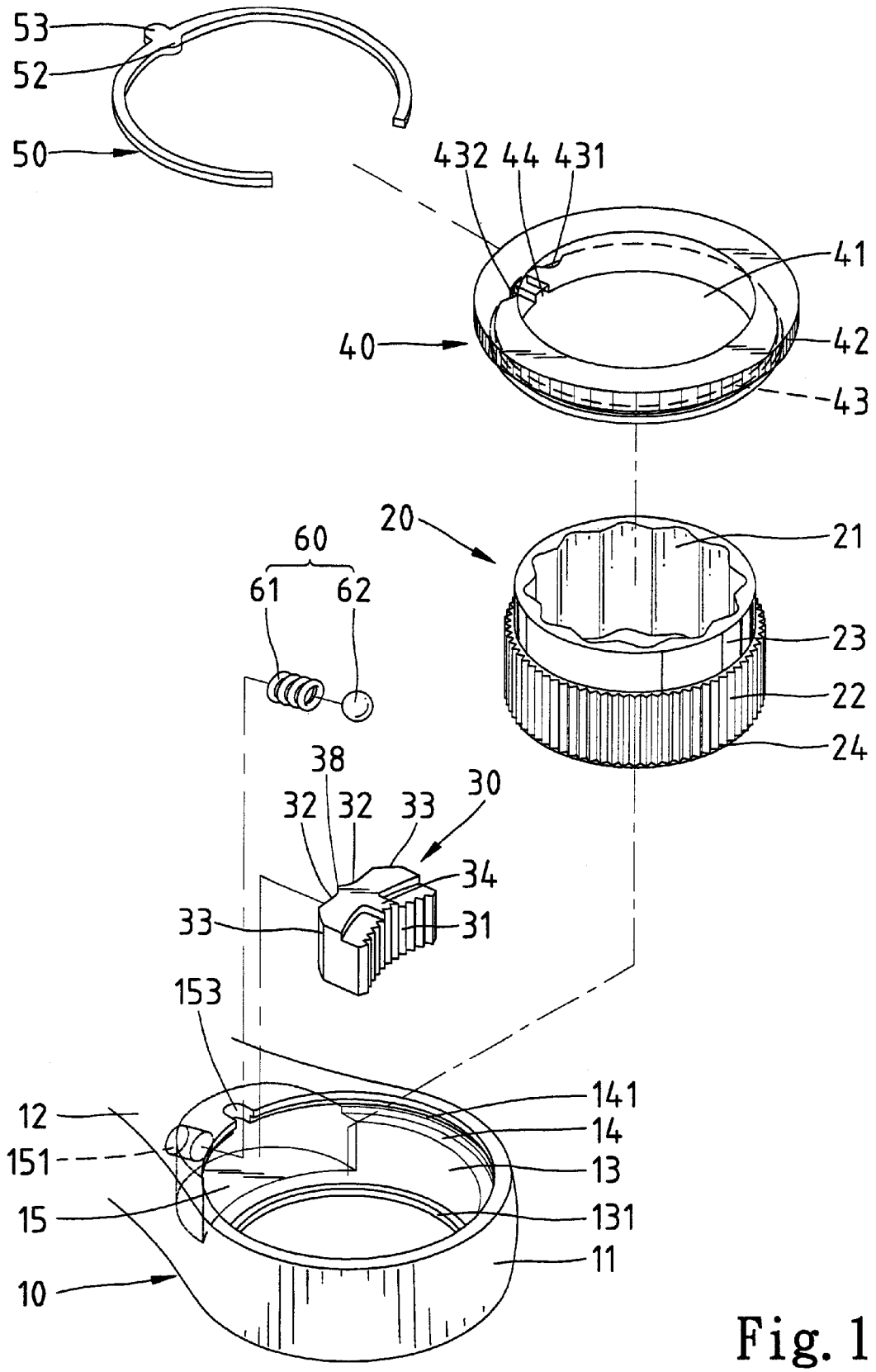
FIG. 19 is an exploded perspective view of a third embodiment of the reversible ratchet-type wrench in accordance with the present invention.
Figure 20:
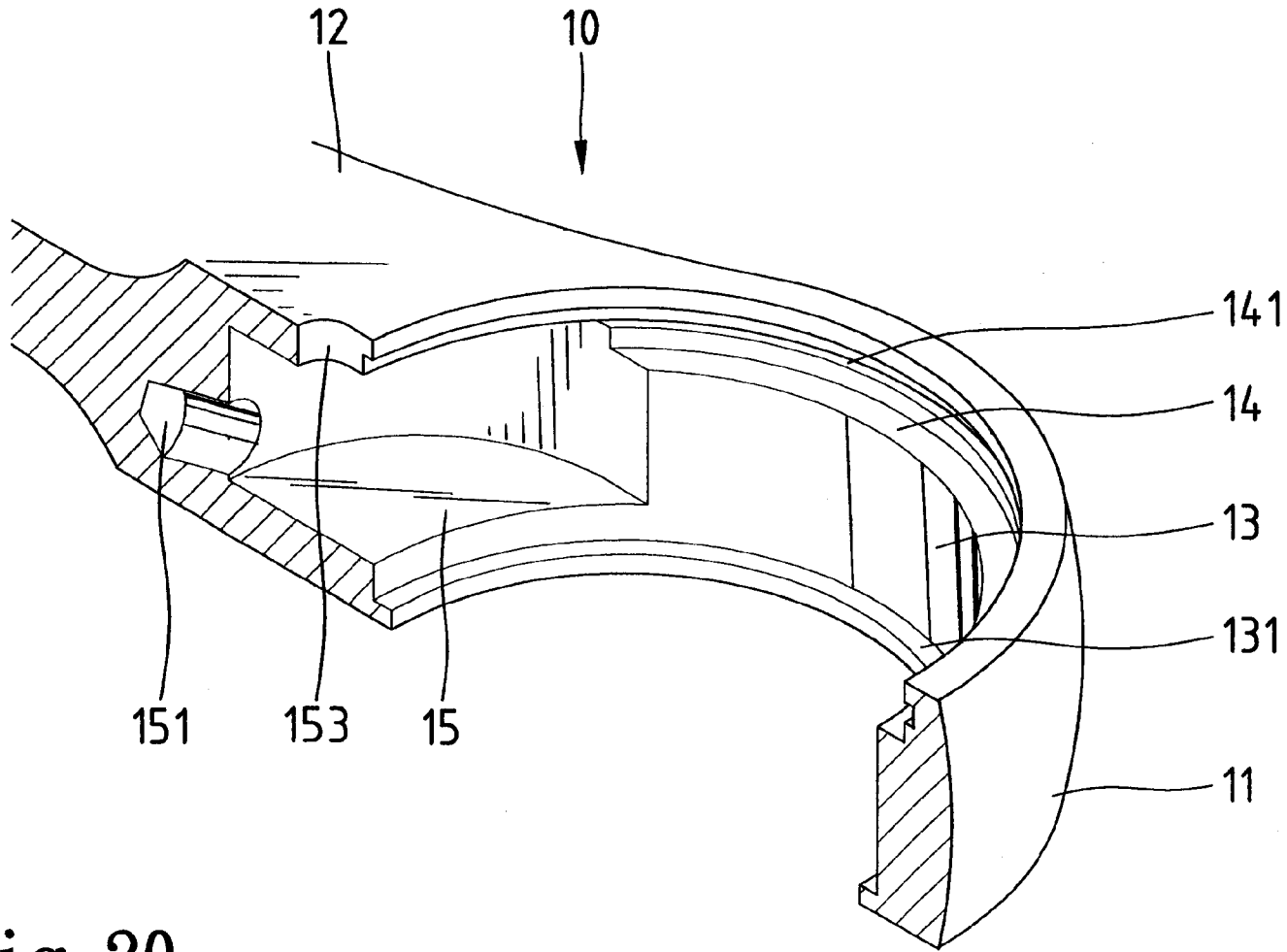
FIG. 20 is a partly-cutaway perspective view illustrating a head of the wrench in FIG. 19.
Figure 21:
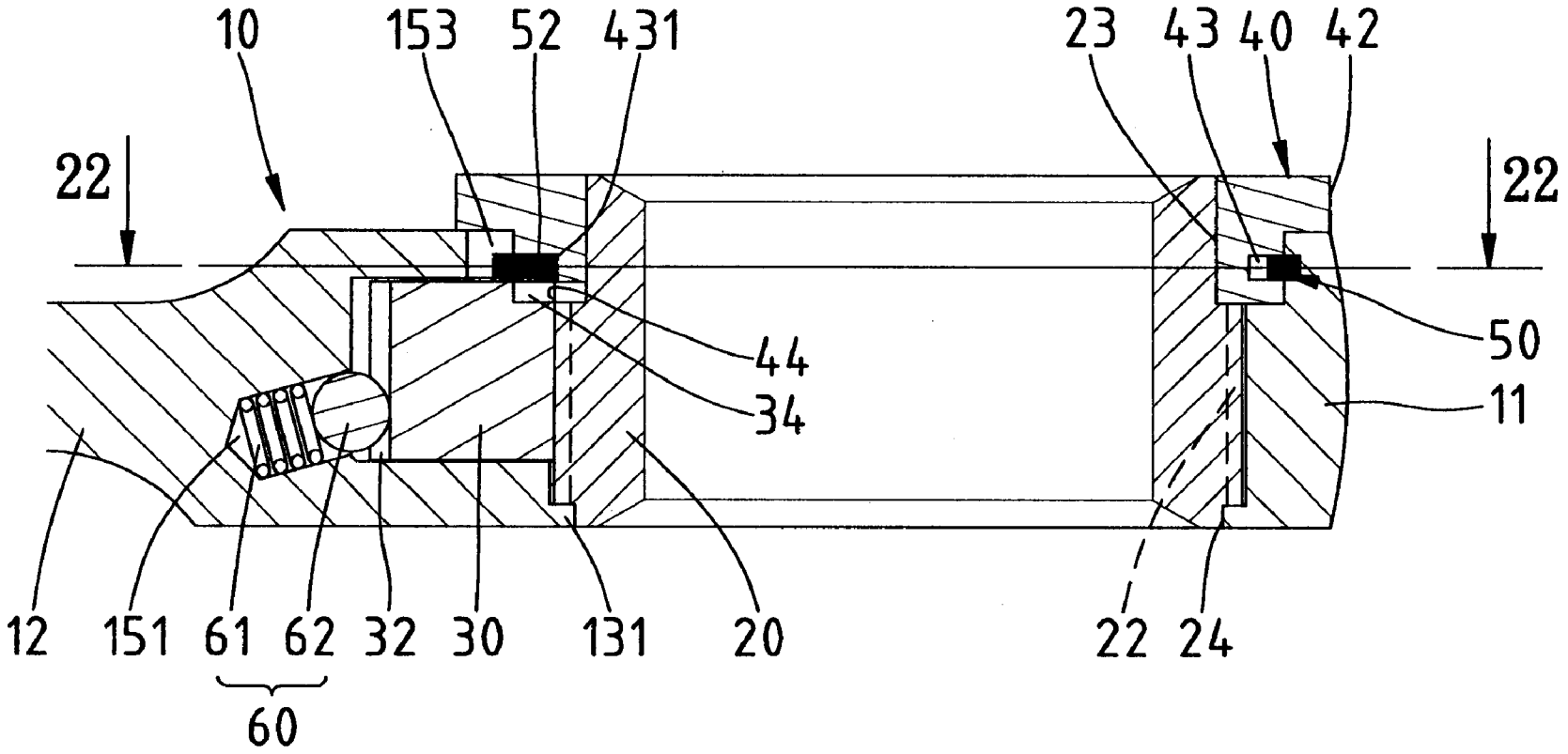
FIG. 21 is a sectional view of the wrench in FIG. 19.

Referring to FIG. 17, when switching of the ratcheting direction of the wrench is required, the flange 42 of the switching ring 40 is turned, e.g., clockwise to disengage the first retaining section 431 of the switching ring 40 from the inner protuberance 52 of the retainer ring 50 until the inner protuberance 52 is engaged in the second retaining section 432 of the switching ring 40 when shown in FIG. 11. It is noted that the pawl 30 moves together with the switching ring 40, as the protrusion 34 of the pawl 30 is located in the lower portion of the notch 44 of the switching ring 40, and the ball 62 moves across the ridge 38 (FIG. 17) and is then engaged in the other retaining groove 32 of the pawl 30 (FIG. 18). It is noted that the section of the retainer ring 50 between the outer protuberances 51 :is slightly moved backward during switching of the ratcheting direction, and the section restores its shape after completion of the switching of the ratcheting direction.

As illustrated in FIG. 18, the pawl 30 is moved to the upper portion of the compartment 15 with the other pressing end 33 pressing against another portion of the wall defining the compartment 15. It is noted that the protrusion 34 of the pawl 30 is now located in an upper portion of the notch 44 of the switching ring 40, allowing sliding movement of the pawl 30 without causing movement of the switching ring 40 during counterclockwise free rotation of the wrench 10.

Figure 22:
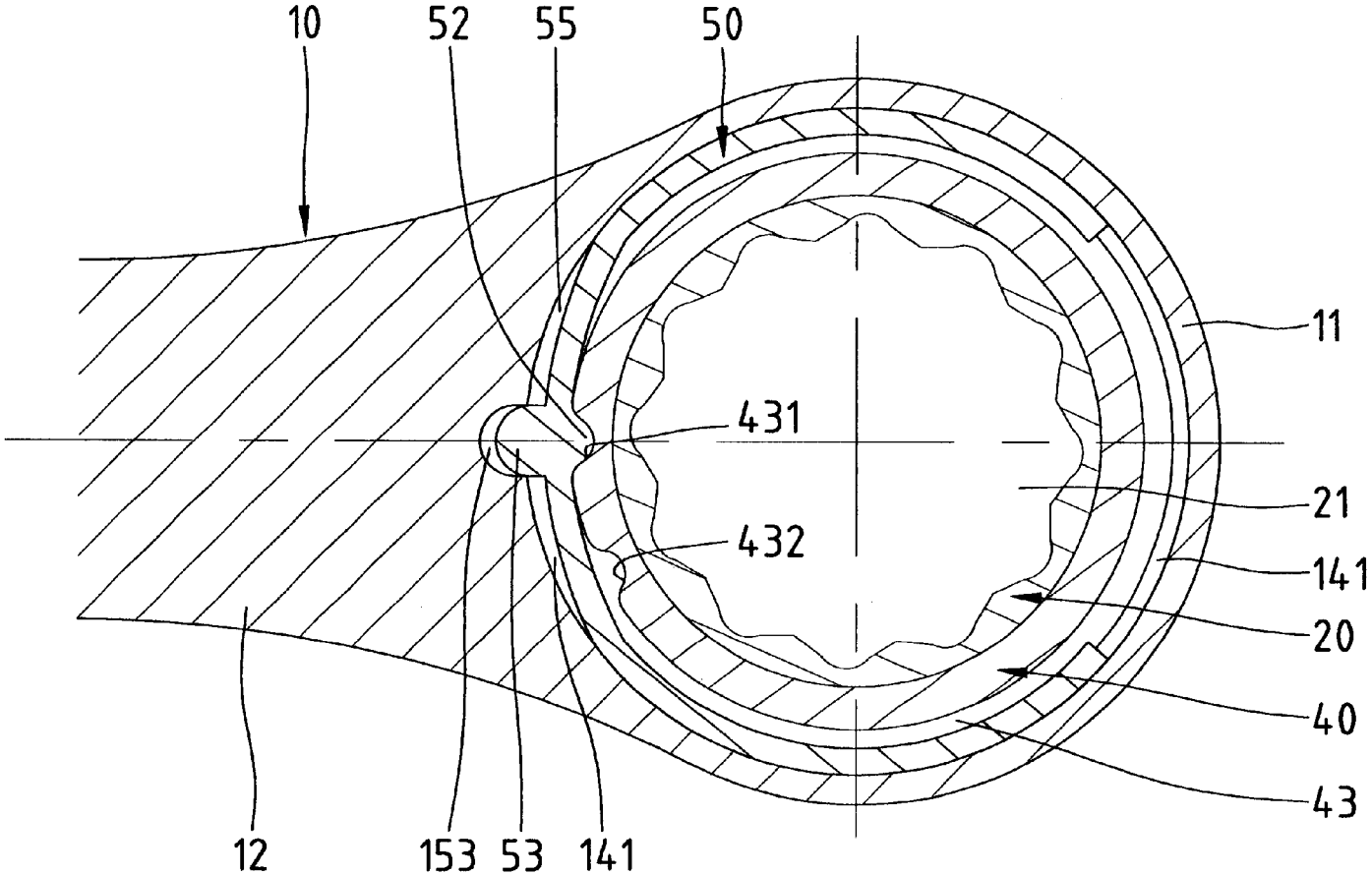
FIG. 22 is a sectional view taken alone plane 21—21 in FIG. 20.
Figure 23:
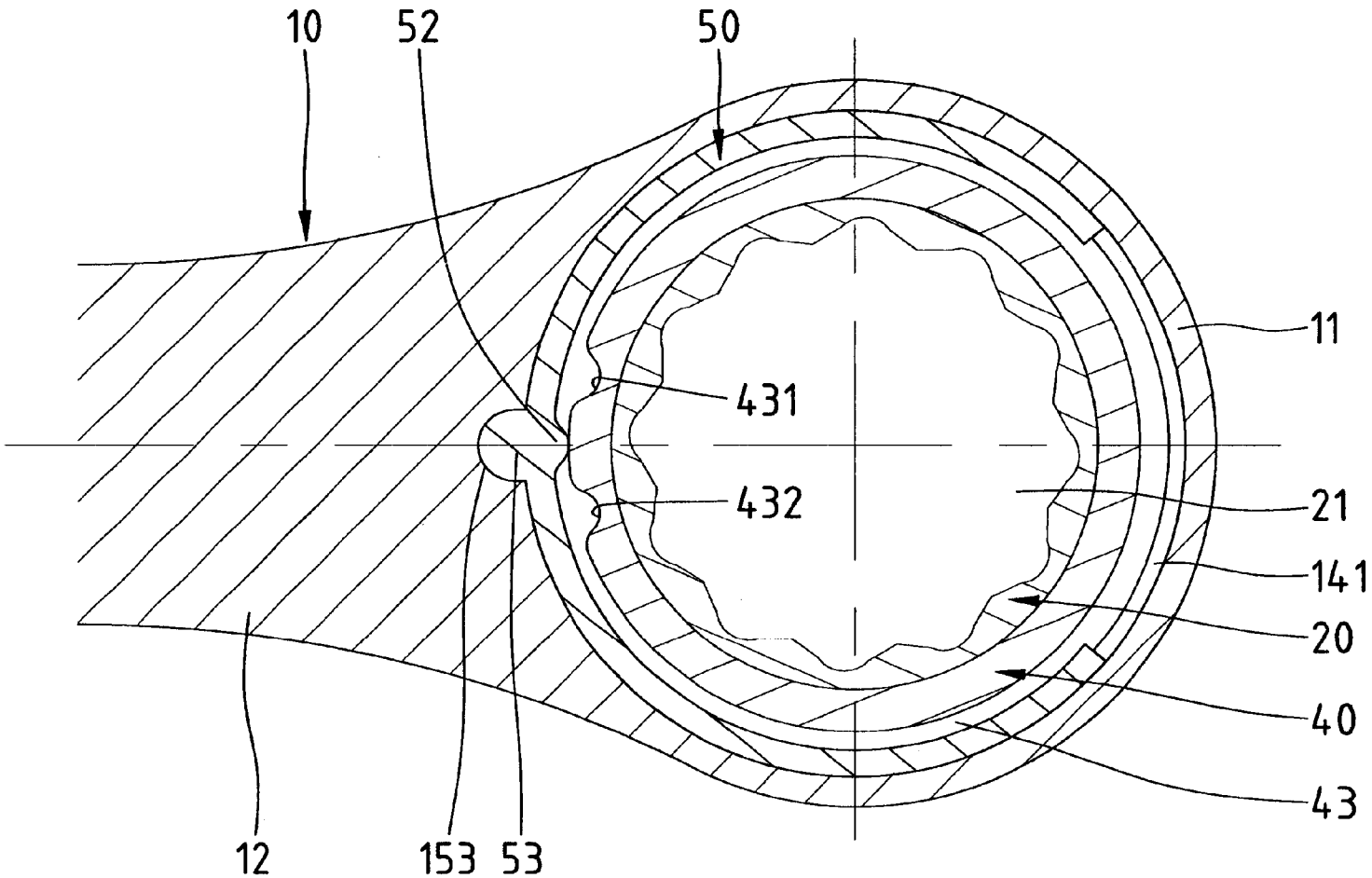
FIG. 23 is a sectional view similar to FIG. 22, illustrating a transition position of the switching ring of the wrench.

FIGS. 19–24 illustrate a third embodiment of the invention, wherein like numerals denotes like elements. In this embodiment, the stepped portion 152 of the compartment 15 is omitted, and a positioning hole 153 is defined in a central portion of the upper portion of the wall defining the compartment 15, best shown in FIGS. 20 and 21. Further, the retainer ring 50 has a positioning protuberance 53 on the outer periphery thereof to replace the two outer protuberances 51 in the above embodiments. The positioning protuberance 53 is slidably received in the positioning hole 153 to prevent rotation of the retainer ring 50 relative to the wrench 10. As illustrated in FIG. 22, a gap 55 is defined between a section of the retainer ring 53 from which the outer protuberance 51 projects outward. The positioning hole 153 is longer than the positioning protuberance 53.

Referring to FIG. 22, when switching of the ratcheting direction of the wrench 10 is required, the switching ring 40 is turned, e.g., clockwise, since a gap 55 is defined between the peripheral wall defining the hole 13 of the head 11 and a section of the retainer ring 53 from which the positioning protuberance 53 projects outward and since the positioning hole 153 is longer than the positioning protuberance 53, the section of the retainer ring 50 is allowed to move slightly outward during switching of the ratcheting direction of the wrench 10. And the section of the retainer ring 50 restores its shape after completion of the switching of the ratcheting direction. It is noted that the inner protrusion 52 moves across a section of the outer periphery of the switching ring 40 between the two retaining grooves 431 and 432 during switching of the ratcheting direction of the wrench 10.

Figure 24:
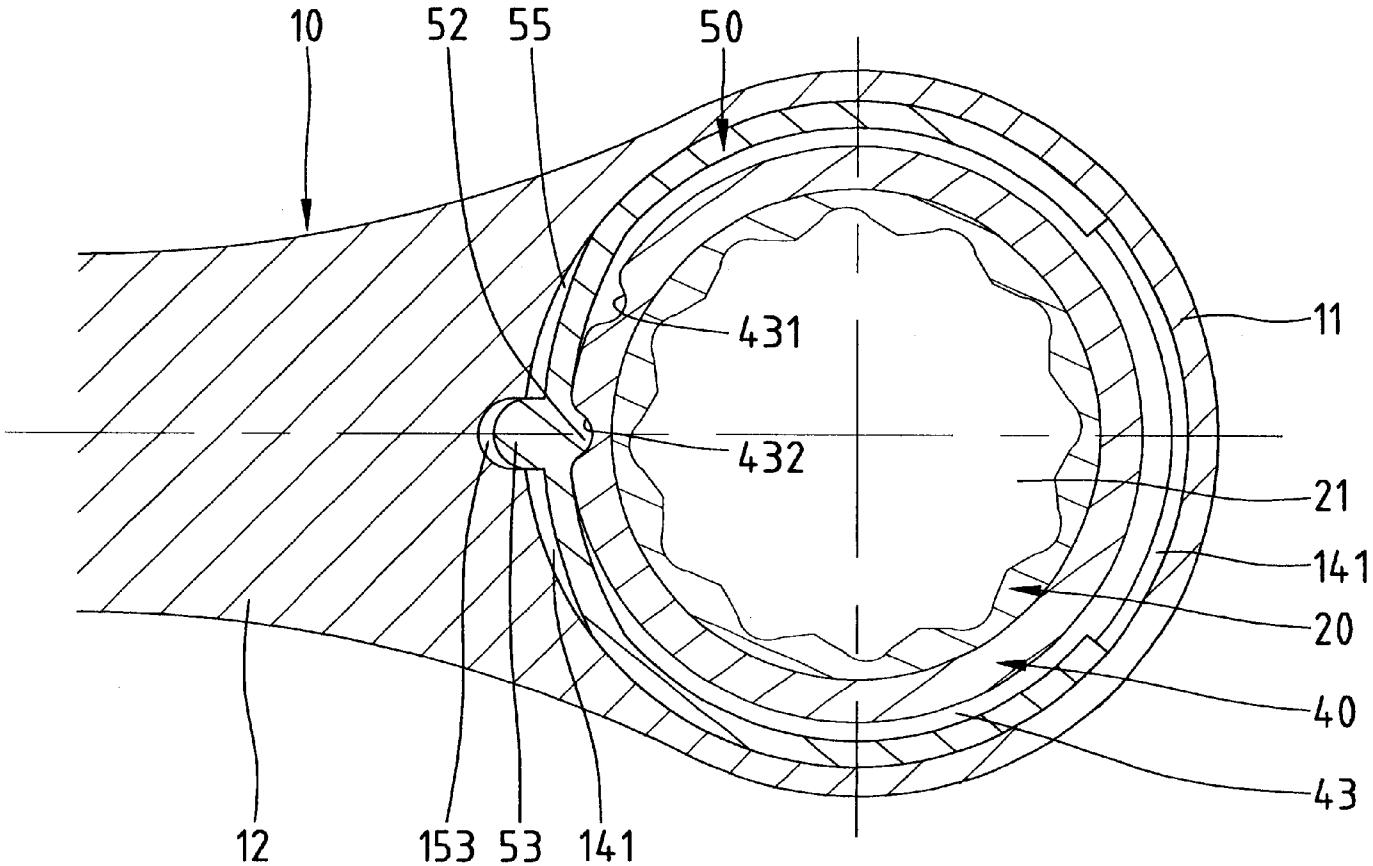
FIG. 24 is a sectional view similar to FIG. 22, illustrating a final position of the switching ring of the wrench after switching of the ratcheting direction.
Figure 25:
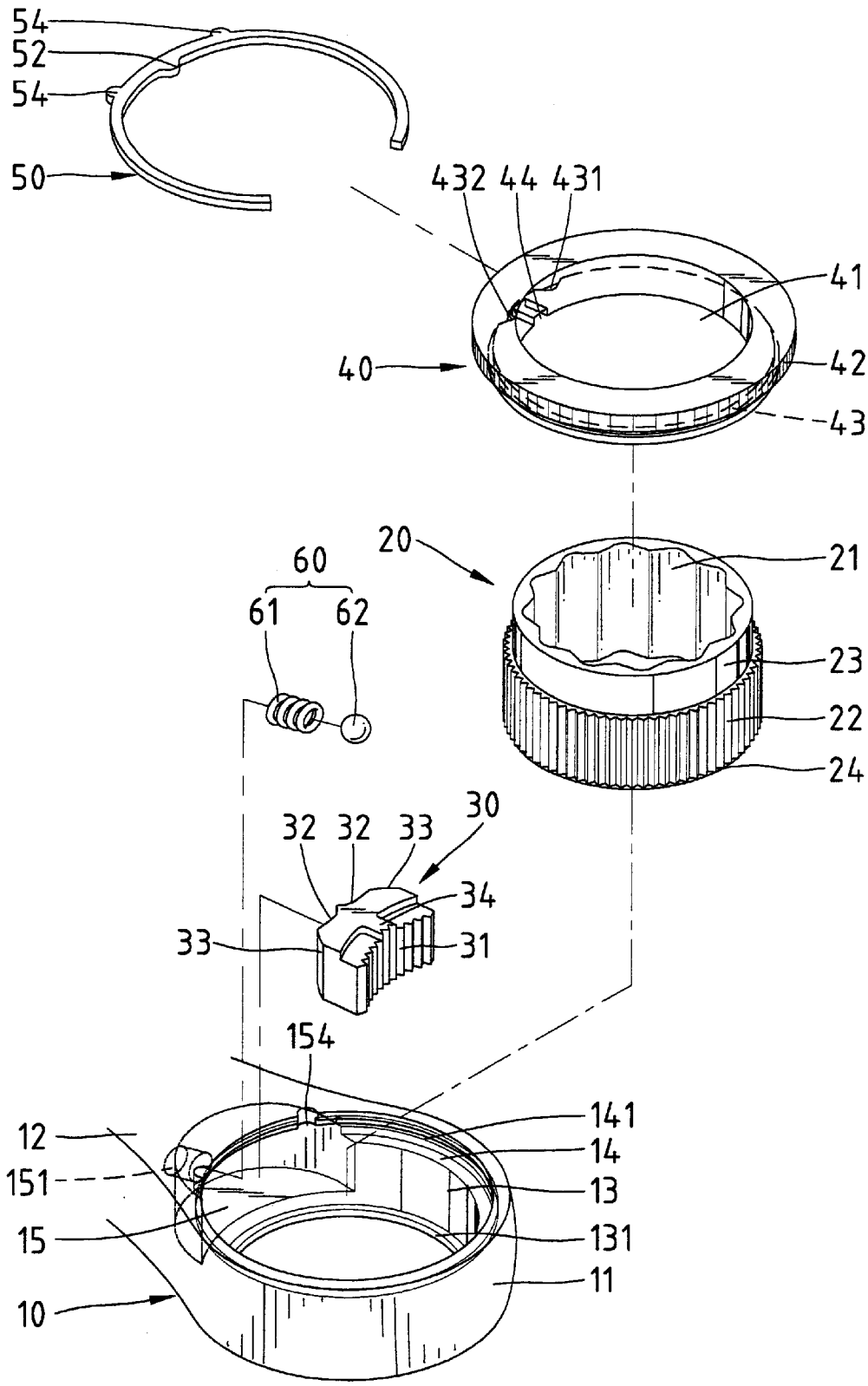
FIG. 25 is an exploded perspective view of a forth embodiment of the reversible ratchet-type wrench in accordance with the present invention.
Figure 26:
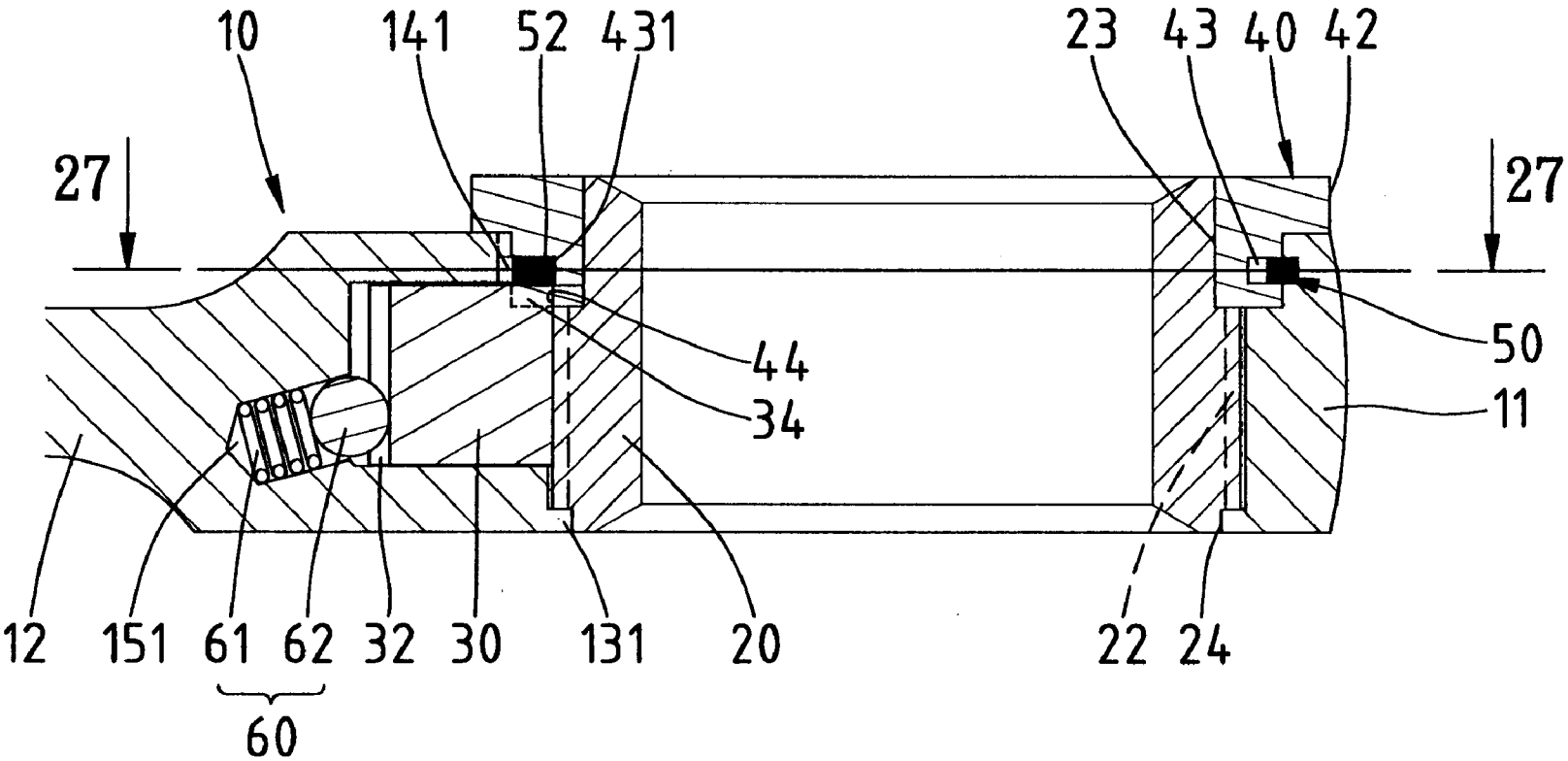
FIG. 26 is a sectional view of the wrench in FIG. 25.
Figure 27:
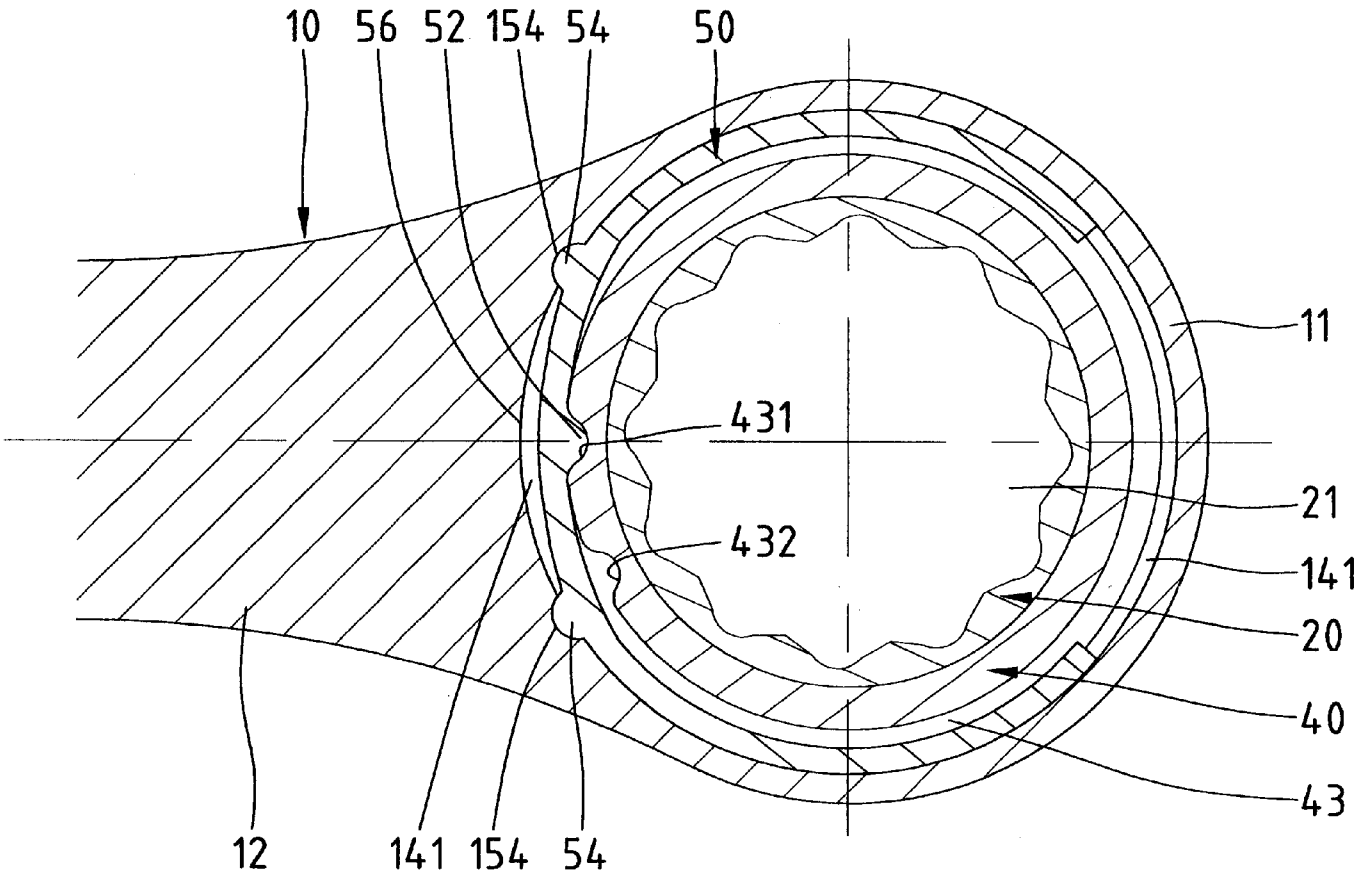
FIG. 27 is a sectional view taken alone plane 27—27 in FIG. 26.

As illustrated in FIG. 24, the pawl 30 is moved to the upper portion of the compartment 15 with the other pressing end 33 pressing against another portion of the wall defining the compartment 15. It is noted that the protrusion 34 of the pawl 30 is now located in an upper portion of the notch 44 of the switching ring 40, allowing sliding movement of the pawl 30 without causing movement of the switching ring 40 during counterclockwise free rotation of the wrench 10.

FIGS. 25–29 illustrate a fourth embodiment of the invention, wherein like numerals denotes like elements. In this embodiment, the stepped portion 152 of the compartment 15 is omitted, and two positioning holes. 154 are respectively defined in two ends of the upper portion of the wall defining the compartment 15, best shown in FIGS. 25 and 27. Further, the retainer ring 50 has two positioning protuberances 53 formed on the outer periphery thereof and respectively engaged in the positioning holes 153 to prevent rotation of the retainer ring 50 relative to the wrench 10. As illustrated in FIG. 22, a gap 56 is defined between a section of the retainer ring 53 between the positioning protuberances 54.

Figure 28:
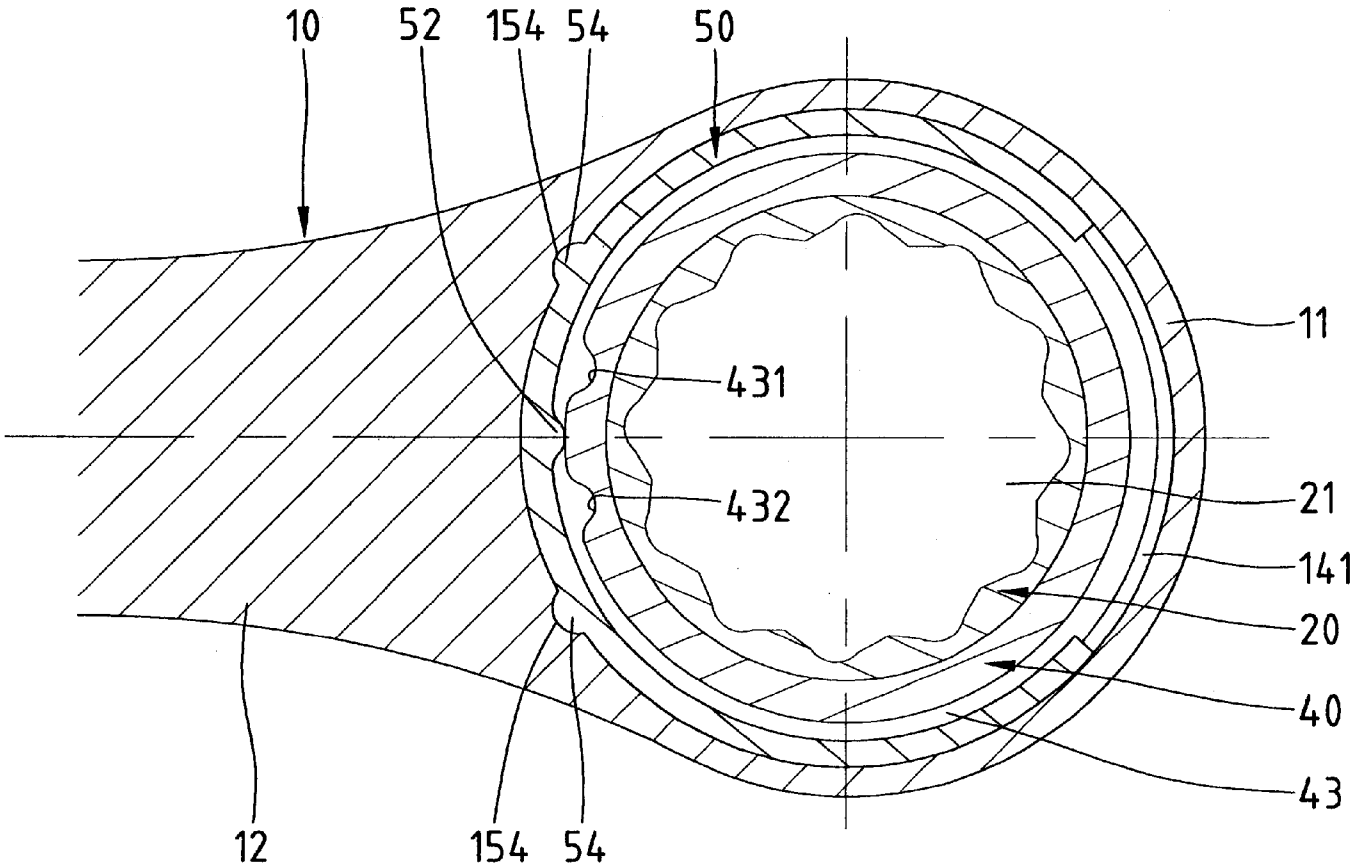
FIG. 28 is a sectional view similar to FIG. 27, illustrating a transition position of the switching ring of the wrench.

Referring to FIG. 28, when switching of the ratcheting direction of the wrench 10 is required, the switching ring 40 is turned, e.g., clockwise, since a gap 56 (FIG. 27) is defined between the peripheral wall defining the hole 13 of the head 11 and a section of the retainer ring 53 between the positioning protuberances 54 projects outward, the section of the retainer ring 53 is allowed to move slightly outward during switching of the ratcheting direction of the wrench 10. And the section of the retainer ring 50 restores its shape after completion of the switching of the ratcheting direction. It is noted that the inner protrusion 52 moves across a section of the outer periphery of the switching ring 40 between the two retaining grooves 431 and 432 during switching of the ratcheting direction of the wrench 10.

Figure 29:
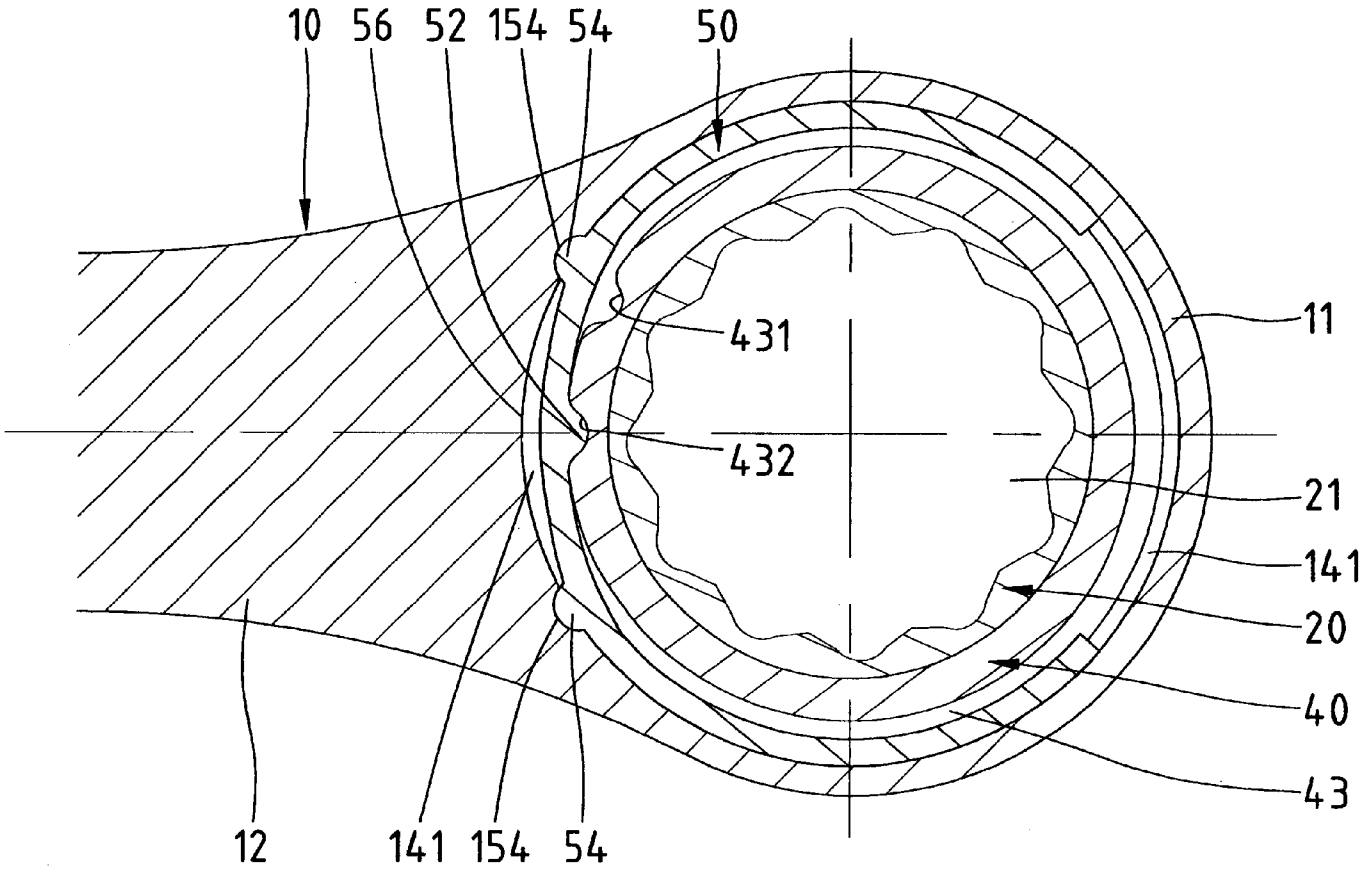
FIG. 29 is a sectional view similar to FIG. 27, illustrating a final position of the switching ring of the wrench after switching of the ratcheting direction.

As illustrated in FIG. 29, the pawl 30 is moved to the upper portion of the compartment 15 with the other pressing end 33 pressing against another portion of the wall defining the compartment 15. It is noted that the protrusion 34 of the pawl 30 is now located in an upper portion of the notch 44 of the switching ring 40, allowing sliding movement of the pawl 30 without causing movement of the switching ring 40 during counterclockwise free rotation of the wrench 10.

Figure 30:
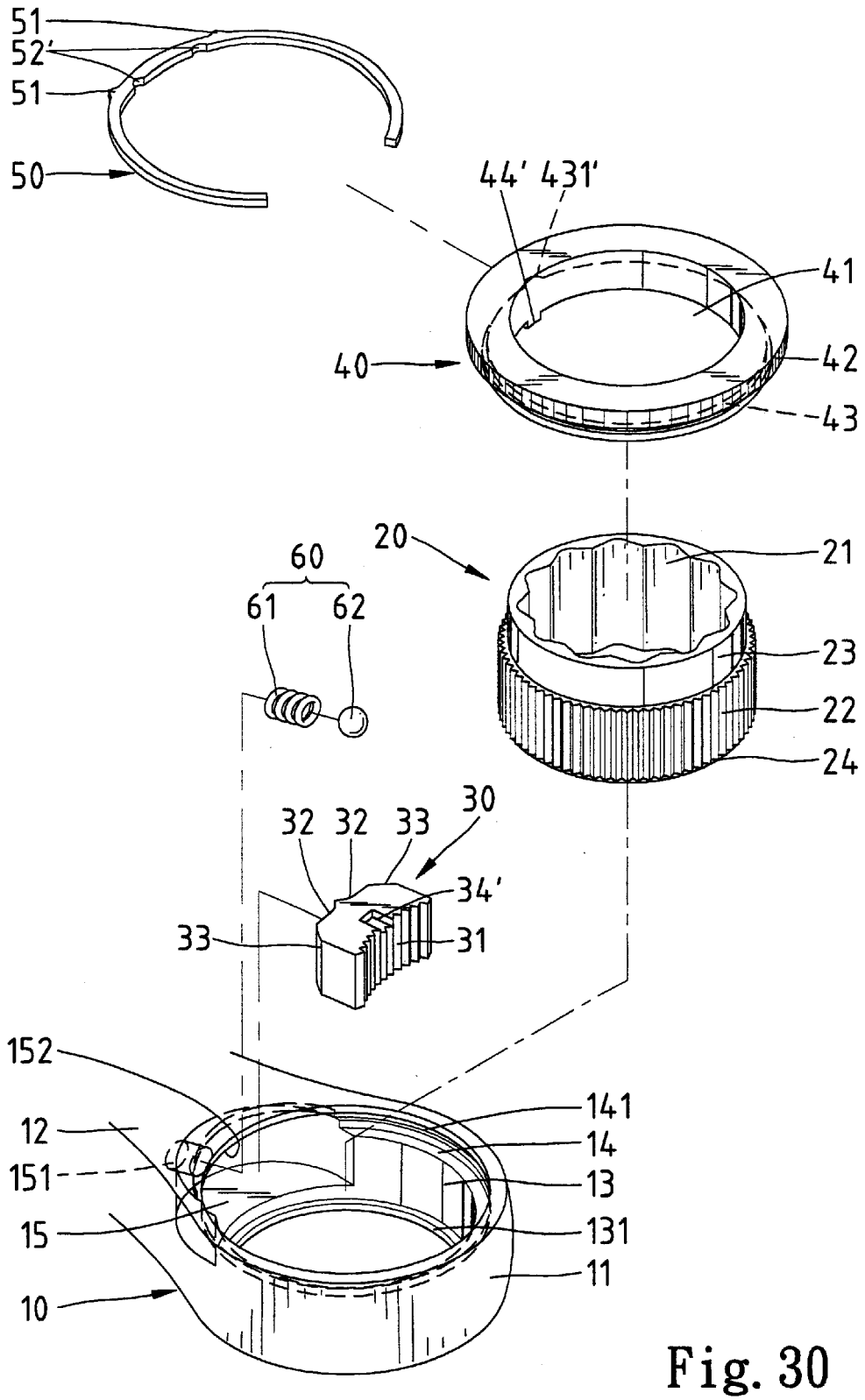
FIG. 30 is an exploded perspective view of a fifth embodiment of the reversible ratchet-type wrench in accordance with the present invention.

FIG. 30 illustrates a fifth embodiment of the invention that is modified from the first embodiment in FIG. 2, wherein the notch 44 of the switching ring 40 is replaced by a protrusion 44', and the protrusion 34 on the pawl 30 is replaced by a notch 34' that is wider than the protrusion 44' on the switching ring 40. Further, the inner protuberance 52 of the retainer ring 50 is replaced by two retaining sections in the form of grooves 52', and the retaining sections 431 and 432 of the switching ring 40 are placed by a protuberance 431. It is noted that these arrangements can also be applied to any embodiment described above.

Figure 31:
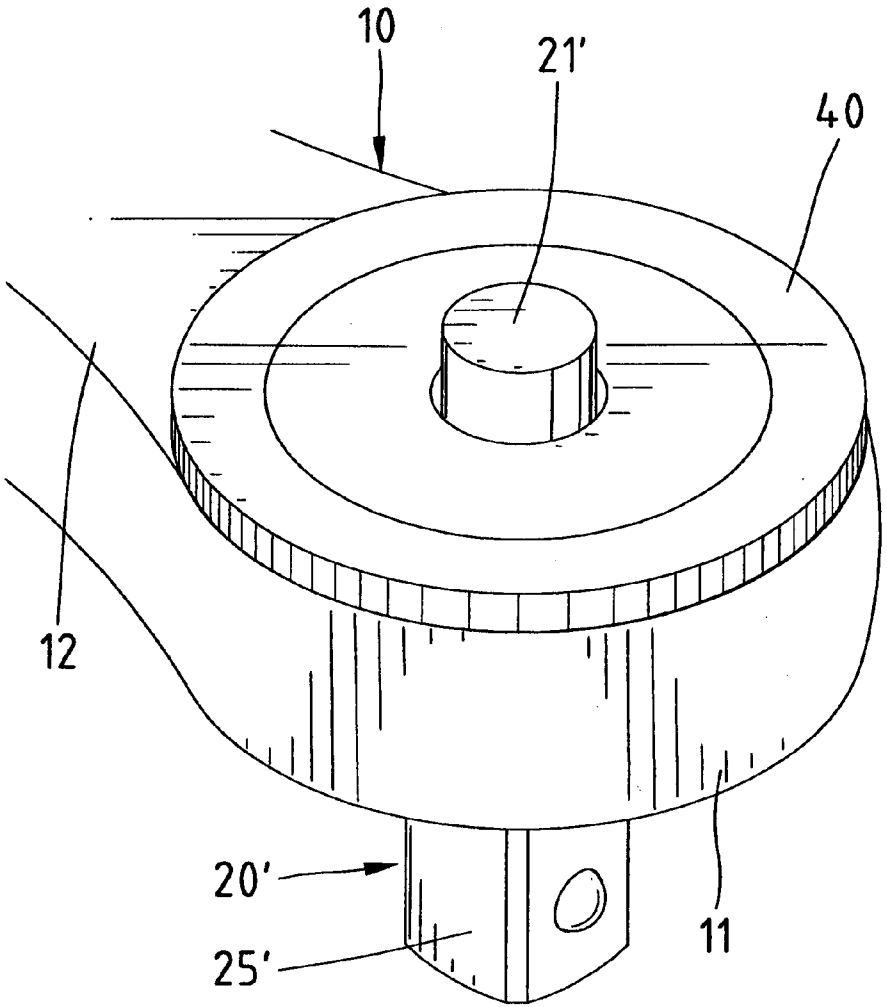
FIG. 31 is a perspective view of a sixth embodiment of the ratchet-type wrench in accordance with the present invention.
Figure 32:
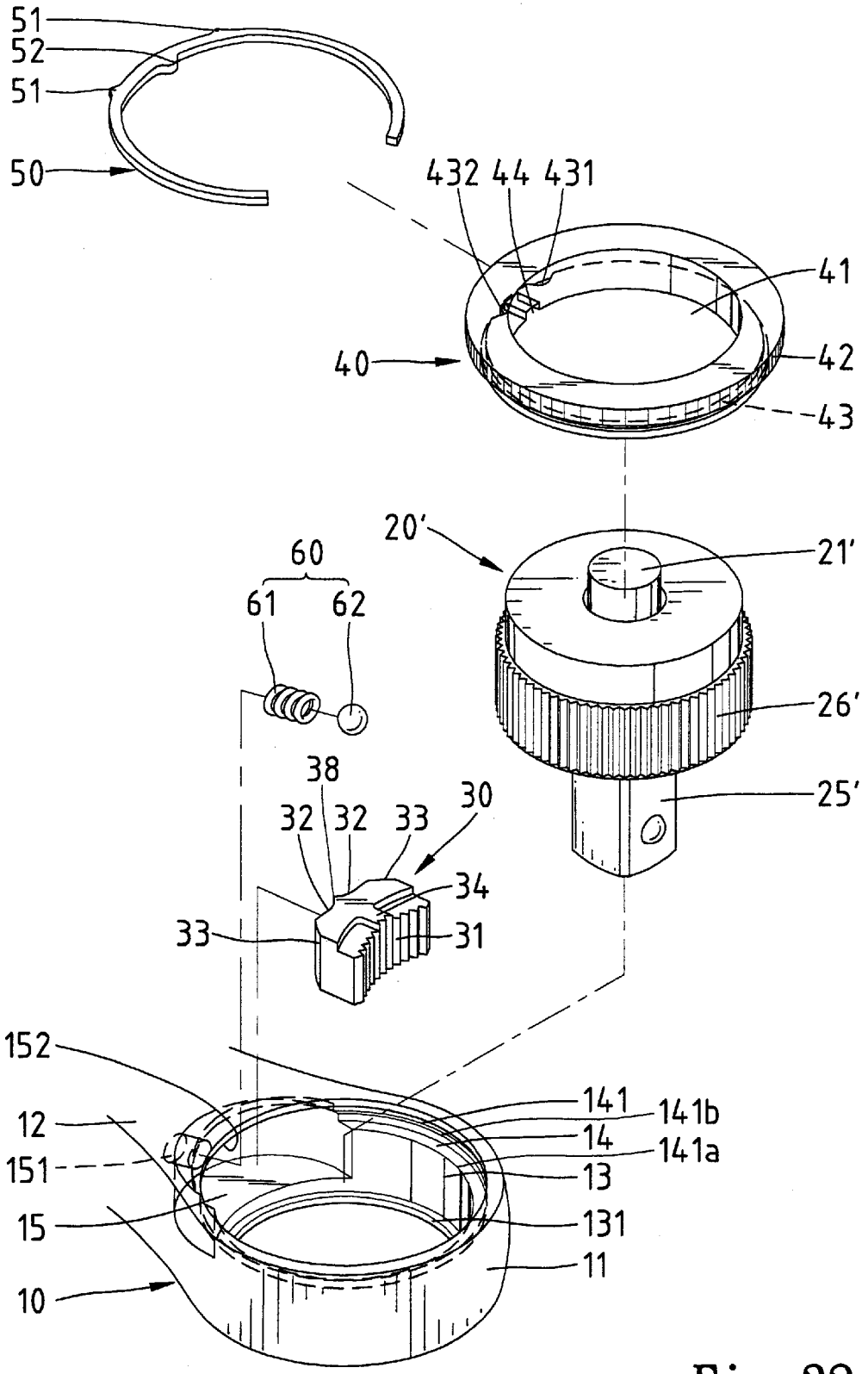
FIG. 32 is a sectional view of the wrench in FIG. 31.

FIGS. 31 and 32 illustrate a sixth embodiment of the invention, wherein the drive member (now designated by 20') includes a gear wheel 26' rotatably mounted in the hole 13 of the head 11, a drive column 25' extending downward from a bottom side of the gear wheel for releasably engaging with a socket (not shown), and an engaging rod 21' extending upward from a top side of the gear wheel 26'. The switching ring 40 is mounted around the engaging rod 21'. The elements used in the previous embodiments can be used in this embodiment without adversely affecting the functions.

According to the above description, it is appreciated that the switching ring 40 is reliably retained in place during operation of the wrench 10. The switching ring 40 is mounted in the compartment 15 of the wrench 10, and no end cap is required for sealing the wrench. Further, no further hole is drilled in the wall defining the hole 13 of the head 11. Structure of the head 11 of the wrench 10 is not sacrificed. Further, the pawl 30 is allowed to slide away from the drive member 20 without causing movement of the switching ring 40. Further, the retainer ring 50 has two functions, one for mounting the switching ring 40 while allowing rotation of the switching ring 40, and the other for reliably positioning the switching ring 40 in position during free rotation of the wrench. The number of the elements of the wrench in accordance with the present invention is fewer than that in conventional designs and the structure is simplified without sacrificing the strength of the wrench.

Although the invention has been explained in relation to its preferred embodiments, it is to be understood that many other possible modifications and variations can be made without departing from the scope of the invention as hereinafter claimed.

What is claimed is:

1. A wrench comprising:

a handle (12);

a head (11) extending from the handle (12) and including a hole (13), a peripheral wall defining the hole (13) of the head including a compartment (15), an annular groove (141) being defined in an end of the peripheral wall defining the hole (13), the annular groove (141) being partially coincident with the compartment (15);

a drive member (20) rotatably mounted in the hole (13) of the head (11) and including a plurality of teeth (22) in an outer periphery thereof;

a pawl (30) slidably received in the compartment (15) and including a first side having a plurality of teeth (31) and a second side opposite to the first side, the pawl (30) further including a first engaging member (34; 34') formed thereon;

a pressing member (62) mounted in the compartment (15);

an elastic element (61) mounted in the compartment (15) for urging the pressing member to press against the second side of the pawl (30) for engaging the teeth (31) of the pawl (30) with the teeth (22) of the drive member (20);

a switching member (40) having a first end mounted in the hole (13) of the head (11) and a second end outside the head for manual operation, the first end of the switching member (40) including an annular groove (43) in an outer periphery thereof, the switching member (40) further including a second engaging member (44; 44') for engaging with the first engaging member (34; 34') of the pawl (30); and a retainer ring (50) partially engaged in the annular groove (43) of the switching member (40) and partially engaged in the annular groove (141) of the head (11), the retainer ring (50) being retained in place by a wall defining the compartment (15);

one of the switching member (40) and the retainer ring (50) including two retaining sections (431, 432; 52'), and the other of the switching member (40) and the retainer ring (50) including a third engaging member (52; 431') for selectively engaging with one of the retaining sections (431, 432; 52');

wherein the second end of the switching member (40) being manually turnable to make the third engaging member (52; 431') engage with one of the retaining sections (431, 432; 52') and to move the pawl (30) through engagement between the first engaging member (34; 34') and the second engaging member (44; 44');

wherein the first engaging member (34; 34') and the second engaging member (44; 44') are so configured that the switching member (40) is not moved when the pawl (30) moves as a result of free rotation of the wrench.

2. The wrench as claimed in claim 1, wherein the compartment (15) includes a stepped portion (152) in an end thereof, the stepped portion (152) being partially coincident with the annular groove (141) of the head (11) and having two ends, the retainer ring (50) including two outer protuberances (51) on an outer periphery thereof that respectively abut against the ends of the stepped portion (152), thereby positioning the retainer ring. (50) in place.

3. The wrench as claimed in claim 1, wherein the first engaging member of the pawl (30) is a protrusion (34), and wherein the second engaging member (44) of the switching member (40) is a notch (44) that is wider than the protrusion (34).

4. The wrench as claimed in claim 2, wherein the first engaging member of the pawl (30) is a protrusion (34), and wherein the second engaging member (44) of the switching member (40) is a notch (44) that is wider than the protrusion (34).

5. The wrench as claimed in claim 1, wherein the retaining sections are two grooves (431, 432) in the switching member (40), and wherein the third engaging member is an inner protuberance (52) on an inner periphery of the retainer ring (50).

6. The wrench as claimed in claim 1 wherein the first engaging member of the pawl (30) is a notch (34'), and wherein the second engaging member of the switching member (40) is a protrusion (44') that is narrower than the notch (34').

7. The wrench as claimed in claim 1, wherein the retaining sections are two grooves (52') in an inner periphery of the retainer ring (50), and wherein the third engaging member is a protuberance (431') on the switching member (40).

8. The wrench as claimed in claim 1, wherein the wall defining the compartment (15) includes at least one positioning groove (153; 154), the retainer ring (50) including at least one positioning protuberance (53; 54) on an outer periphery thereof, said at least one positioning protuberance (53; 54) of the retainer ring (50) being received in said at least one positioning groove (153; 154) to thereby retain the retainer ring in place.

9. The wrench as claimed in claim 8, wherein the first engaging member of the pawl (30) is a protrusion (34), and wherein the second engaging member of the switching member (40) is a notch (44) that is wider than the protrusion (34).

10. The wrench as claimed in claim 8, wherein the first engaging member of the pawl (30) is a notch (34'), and wherein the second engaging member of the switching member (40) is a protrusion (44') that is narrower than the notch (34').

11. The wrench as claimed in claim 8, wherein a gap (55; 56) is defined between the outer periphery of the retainer ring (50) and a wall defining the hole (13) of the head (11), allowing the retainer ring (50) to deform during switching of ratcheting direction of the wrench.

12. The wrench as claimed in claim 1, wherein a cavity (151) is defined in a wall defining the compartment (15), and the elastic element (61) and the pressing member (62) are mounted in the cavity (151).

13. The wrench as claimed in claim 1, wherein the outer periphery of the drive member (20) includes a recessed section (23) in an end thereof, the switching member (40) being a ring mounted around the recessed section (23) of the drive member (20).

14. The wrench as claimed in claim 13, wherein the second end of the switching member (40) includes a flange (42), the flange (42) abutting against the recessed section (23) of the drive member (20).

15. The wrench as claimed in claim 1, further including an annular ledge (131) extending inward from another end of the peripheral wall defining the hole (13) of the head (11), the outer periphery of the drive member (20) including a recessed section (24) in an end thereof, the recessed section (24) of the drive member (20) abutting against the annular ledge (131) of the head (11).

16. The wrench as claimed in claim 1, wherein the second side of the pawl (30) includes two retaining grooves (32) spaced by a ridge (38).

17. The wrench as claimed in claim 1, wherein the pawl (30) includes two pressing ends (33) for selectively pressing the wall defining the compartment (15).

18. The wrench as claimed in claim 1, wherein the drive member (20) is a gear wheel having an inner periphery (21).

19. The wrench as claimed in claim 1, wherein the drive member (20) includes a gear wheel (26') and a drive column (25') for engaging with a socket.

20. The wrench as claimed in claim 1, wherein the end of the peripheral wall defining the hole (13) of the head (11) includes a stepped portion (14), and wherein the annular groove (141) of the head (11) is defined in the stepped portion (14).

* * * * *